US011498730B2

(12) United States Patent
Kachian et al.

(10) Patent No.: US 11,498,730 B2
(45) **Date of Patent: *Nov. 15, 2022**

(54) CHILD-RESISTANT CONTAINERS AND PACKAGING

(71) Applicant: More Agency, Inc., Van Nuys, CA (US)

(72) Inventors: Ruben Kachian, Van Nuys, CA (US); Mike Toroyan, Granada Hills, CA (US)

(73) Assignee: Raymond Christopher Enterprises LLC, Livonia, MI (US)

( * ) Notice: Subject to any disclaimer, the term of this patent is extended or adjusted under 35 U.S.C. 154(b) by 0 days.

This patent is subject to a terminal disclaimer.

(21) Appl. No.: 17/083,192

(22) Filed: Oct. 28, 2020

(65) Prior Publication Data

US 2021/0039848 A1 Feb. 11, 2021

Related U.S. Application Data

(63) Continuation-in-part of application No. 16/528,554, filed on Jul. 31, 2019, now Pat. No. 11,220,380.

(60) Provisional application No. 62/712,874, filed on Jul. 31, 2018.

(51) Int. Cl.

| | |
|---|---|
| ***B65D 43/16*** | (2006.01) |
| ***B65D 50/04*** | (2006.01) |
| ***B65D 55/04*** | (2006.01) |

(52) U.S. Cl.

CPC ..... *B65D 50/04* (2013.01); *B65D 55/04* (2013.01); *B65D 2215/02* (2013.01); *B65D 2255/20* (2013.01)

(58) Field of Classification Search

CPC .... B65D 2215/02; B65D 43/22; B65D 43/16; B65D 43/163; B65D 5/38; B65D 25/14; B65D 45/00

USPC ..... 206/532, 531, 1.5; 132/293; 220/315

See application file for complete search history.

(56) References Cited

U.S. PATENT DOCUMENTS

| | | | | |
|---|---|---|---|---|
| 2002/0185404 | A1 | 12/2002 | Donegan | |
| 2008/0215440 | A1 * | 9/2008 | Peterson | B65D 77/046 53/473 |
| 2009/0152134 | A1 | 6/2009 | Katsis | |
| 2014/0151388 | A1 | 6/2014 | Culeron | |
| 2016/0251107 | A1 * | 9/2016 | Everett | B65D 59/04 206/1.5 |
| 2018/0037380 | A1 * | 2/2018 | Giraud | B65D 50/02 |
| 2020/0039707 | A1 | 2/2020 | Kachian | |

* cited by examiner

*Primary Examiner* — King M Chu

(74) *Attorney, Agent, or Firm* — Lowry Blixseth APC; Scott M. Lowry

(57) ABSTRACT

The child-resistant container includes a receptacle having an inner cavity, a lid that selectively couples with the receptacle to enclose the inner cavity when in a locked position, and a lock movable between the locked position securing the lid to the receptacle to substantially prevent access to the inner cavity and an unlocked position permitting the lid to move relative to the receptacle to expose access to the inner cavity. The receptacle and lid combination may include a lid that pivots relative to a container about a hinge and locks thereto by locking catches in the container sidewalls; or may include an outer housing enclosing an inner storage container in slide-in relation, wherein a pair of safety tabs extend from the inner storage container and through the outer housing into a respective pair of locking channels formed therein.

32 Claims, 34 Drawing Sheets

CHILD-RESISTANT CONTAINERS AND PACKAGING

BACKGROUND OF THE INVENTION

The present invention generally relates to child-resistant containers and/or packaging. More specifically, the present invention relates to child-resistant containers and/or packaging that include a safety lock or latch or a pair of safety tabs requiring a desired minimum level of dexterity to disengage before the container or package may be opened to access contents therein.

In 1970, Congress enacted the Poison Prevention Packaging Act ("PPPA") in response to a relatively high number of children ingesting hazardous household products (e.g., ranging from household cleaning products to prescription medications). According to the U.S. Consumer Products Safety Commission ("CPSC") at the time, poisonings from household products were one of the leading causes of injuries for children under five. Thus, the PPPA was designed to establish a new set of regulations that govern the safety of packaging products that could be harmful to young children if ingested. The basic criteria for PPPA compliant products was that the containers or packaging necessarily needed to increase the difficulty associated with opening the container or package to access the contents therein. Accordingly, this would allow adults—having a certain minimum level of dexterity greater than that of younger children—to open the containers to access product therein, while effectively frustrating a younger child's ability to comparatively do the same.

In time, products created in response to the PPPA have become known as childproof or child-resistant containers and/or packaging due to design features that make it difficult (if not impossible) for children under a certain age to open the container or package to access the contents therein. Child-resistant containers and packaging have thus played an important role in substantially inhibiting children from accessing potentially dangerous products, such as harmful chemicals, medical prescriptions, and other substances that may be particularly harmful if ingested by a child. In fact, such child-resistant container and packaging designs have been so effective in the years since 1970 that oral prescription medicine-related deaths have dropped in the United States from approximately 1.4 deaths per year per million children under five, to a number so low that the CPSC has stopped tracking the statistic.

Some of the most well known child-resistant container designs are those associated with prescription medication bottles having a plastic (and difficult to remove) screw cap feature. For example, such prescription medication bottles come with a cap having a collar that secures over an uppermost portion or rim of the bottle container and closes in secure fashion therewith. The collar typically includes a pair of spring-based push tabs that include vertical extensions for engaging interlocking teeth on the innermost surface of a closure skirt when the cap is fully assembled onto the bottle. To remove the cap, each push tab, which are typically positioned opposite one another, are manually depressed prior to applying unscrewing torque to the cap. Such a downward force disengages the push tab extensions from the interlocking teeth on the cap. Accordingly, once disengaged, the cap can be turned from a locked configuration preventing access to the contents inside the container to an unlocked position permitting cap removal. Such packages with secure caps were considered highly improved child-resistance packaging without significantly impeding access by adults. Still, users necessarily need to use both hands to overcome the child resistant feature to unscrew the closure cap.

While deployment of the abovementioned child-resistant container and cap combination has been effective for use with traditional prescription medications (typically sold in pill or capsule form), in recent years, new issues have arisen as a result of medical products being disseminated in other configurations, such as consumables (e.g., gummies, chocolates, candies, and other like food products). Such medications have become especially popular in the medical marijuana industry where hemp-based therapeutic products (e.g., including CBD) are more commonly sold as food-grade products, in view of continued legalization at the state level over the past 5-10 years. Initially, there were little to no container or packaging requirements. Although, in recent years, states are starting to require that both medical and recreational marijuana products be packaged in child-resistant or childproof packaging at least at the point of purchase. This has been accomplished, e.g., by requiring that such medical marijuana products be packaged in a bag incorporating childproof or child-resistant features. Specifically, e.g., edible products such as brownies, cookies, gummies, chocolates, etc. must be sold by dispensaries in hard-to-open packaging (e.g., pouches) difficult for a child to access. Although, the problem with these so-called "exit" bags is that, once home, studies have shown that buyers remove the products (e.g., vaporizers, edibles, flowers, etc.) from the packaging for storage in open or otherwise easily accessible containers that children can access. Thus, children may be exposed to medical marijuana products around the house in what largely amounts to unsafe storage containers and packaging. Current child proof or resistant packaging on the market does not meet the needs for securely storing product or otherwise making it inaccessible for storing medical products or the like post-purchase.

There exists, therefore, a significant need for a child-resistant or childproof container or package for home storage of medical products that substantially prevents or frustrates child access while also allowing adults to access the contents therein. Specifically, such child-resistant containers or packaging should include a safety lock or latch or a pair of safety tabs requiring a desired minimum level of dexterity to disengage before the container or package may be opened to access contents therein. The present invention fulfills these needs and provides further related advantages.

SUMMARY OF THE INVENTION

In one embodiment disclosed herein, a child-resistant tin may include a storage container having an inner cavity for retaining medical products, such as CBD or *Cannabis*-based gummies or candies. The tin may further include a lid movable relative to the storage container between a normal closed position enclosing the inner cavity and the contents therein, and an open position providing access to the inner cavity and the contents therein. The tin may also include a first lock movable between a normal extended position positioned for locking engagement with the lid and an unlocked position disengaged from the lid; and a second lock movable independent of the first lock between its own normal extended position for locking engagement with the lid and its own unlocked position disengaged from the lid. Here, the first lock and the second lock are able to independently retain the lid in the normal closed position such that the lid is only pivotable therefrom to the open position by way of cooperatively positioning the first lock in its unlocked position and the second lock in its unlocked position concurrently.

Further in this respect, the first lock and the second lock may be disposed within the inner cavity and enclosed by a food-grade protective sheath having a size and shape to accommodate each of the first lock and the second lock thereunder. The first lock may be formed integral with a first sidewall of the storage container and the second lock may be formed integral with a second sidewall of the storage container adjacent the first sidewall. Here, the child-resistant tin may be of a rectangular shape. Alternatively, the first lock and the second lock may be formed from the same sidewall or non-adjacent sidewalls.

Moreover, the storage container may also include a generally vertical annular shoulder that transitions at an inwardly projecting step to an interiorly located upper rim having a wall thickness relatively smaller than the annular shoulder. Accordingly, the lid may include a commensurately downwardly extending annular skirt having a reciprocal shape for seated reception on the inwardly projecting step when the lid is in the normal closed position. Here, the downwardly extending annular skirt may encompass the upper rim and generally prevent the lid from moving side-to-side relative to the storage container.

The first lock and the second lock may each include a respective slide block having an outwardly facing release button movable by fingertip engagement with a locking catch normally biased into an outwardly extended position for engagement with a lip of the lid. Here, the locking catches may each include a downwardly facing planar shoulder having a size and shape to remain in locking engagement with the lip. Of course, the first lock may include any number of the release buttons (e.g., two) and the second lock may also include any number of release buttons the same as (e.g., two) or different from (e.g., one or three or more) the first lock. The locking catch may further include a rounded upper surface opposite a downwardly facing planar shoulder, the rounded upper surface permitting slide over engagement of the lid, for eventual enhanced surface area engagement with the downwardly facing planar shoulder. Moreover, the first lock and the second lock may also each include a respective lock housing that includes an interior channel therein for housing a spring generally biasing the slide block in the outwardly extended position.

Additionally, the child-resistant tin may include a third lock movable between a normal extended position positioned for locking engagement with the lid and an unlocked position disengaged from the lid. In this embodiment, the first lock, the second lock, and the third lock may independently retain the lid in the normal closed position such that the lid is only pivotable from the normal closed position to the open position by way of cooperative movement of the first lock to its unlocked position, the second lock to its unlocked position, and the third lock to its unlocked position concurrently.

In another embodiment, a child-resistant package as disclosed herein may include a storage container, a lid coupled with the storage container about a hinge and pivotable between a closed position and an open position for securely storing contents therein, such as medical products, including, e.g., CBD or *Cannabis* infused gummies or candies. A first lock and a second lock may be positioned within the storage container and independently operative relative to one another to secure the lid relative to the storage container to lock the contents therein. The first lock and the second lock may each include at least one release button normally biased into a forward position wherein a catch operable therewith is positioned to retain the lid in the closed position. Here, each release button may be depressible into the storage container independent of one another to move out from within engagement of the lid. As such, the lid may be movable from the closed position to the open position only when the release button of the first lock and the release button of the second lock are concurrently depressed into the storage container.

More specifically, the first lock and the second lock may each include a lock housing retaining a spring therein in engagement with a slide block having the respective release button extending therefrom. Here, each respective release button may extend out from a sidewall of the storage container for easy fingertip depression. Moreover, each catch may include a downwardly facing planar shoulder having an enhanced surface area positioned to engage and retain an inwardly curved lip of the lid when the lid is in the closed position. The catch may also include an arcuate upper surface permitting slide-over movement of the lid from the open position to the closed position wherein the downwardly facing planar shoulder can engage the inwardly curved lip of the lid.

In one embodiment, the child-resistant package may be made from a metal material such as steel, aluminum, or a metal alloy and the first lock may be formed from a front sidewall of the storage container and the second lock may be formed from an adjacent sidewall of the storage container. Alternatively, the child-resistant tin or package may be made from other materials, such as plastic or the like. In this respect, a food-grade sheath may be disposed within an inner surface of the storage container and include a size and shape to accommodate the first lock and the second lock thereunder. In other embodiments, the child-resistant package may include a third lock independently operable of the first lock and the second lock, wherein each of the first lock, the second lock, and the third lock are formed from a different sidewall of the storage container and positioned or otherwise storable beneath and protected by the food-grade sheath.

In another aspect of these embodiments, the storage container may include at least one sidewall having an annular shoulder transitioning at an inwardly projecting step to an interiorly located upper rim having a wall thickness relatively smaller than the annular shoulder. Here, the inwardly projecting step may receive a downwardly extending annular skirt of the lid in seated reception when the child-resistant package is in the closed position. As such, when in this closed position, the downwardly extending annular skirt may encompass the upper rim when in seated reception on the inwardly projecting step, thereby effectively preventing side-to-side movement of the lid relative to the storage container.

In another alternative embodiment, a child-resistant container as disclosed herein may include a receptacle having an inner cavity, a lid that selectively couples with the receptacle in pivoting relation about a hinge to enclose the inner cavity when in a locked position, and a lock movable between the locked position securing the lid to the receptacle to substantially prevent access to the inner cavity and an unlocked position permitting the lid to move relative to the receptacle to expose access to the inner cavity. The child-resistant container may be made from a metal material selected from the group consisting of steel, aluminum, or a metal alloy. Alternatively, the child-resistant container may be made from a paper-based material, such as cardboard or the like. In some embodiments, a food-grade protective sheath may be disposed within an inner surface of the inner cavity and/or within an inner surface of the lid and may be selectively removable and/or replaceable so as to reduce longer-term ownership costs associated with the child-resistant container. In embodiments wherein the lock is disposed within the inner cavity, the protective sheath may also include an indent having a size and shape to accommodate the lock thereunder.

One or more of the sidewalls of the receptacle may include an annular shoulder vertically extending upwardly from a base and transitioning at an inwardly projecting step to an interiorly located upper rim having a wall thickness relatively smaller than the annular shoulder. The lid may include a downwardly extending annular skirt that selectively lands in seated relation on the inwardly projecting step and adjacent the upper rim when the child-resistant container is in the locked position. When seated, the downwardly extending annular skirt may encompass the upper rim to substantially prevent side-to-side movement relative thereto, to help prevent access to the inner cavity. To this end, the lock may include at least one locking catch outwardly extending from the receptacle that may include a downwardly facing planar shoulder that engages an inwardly curved lip of the annular skirt when the lid is in the locked position. Here, the lock may also include at least one channel having a spring therein that normally biases the locking catch and an integrally formed release button in a forward position externally accessible from the receptacle, wherein depression of the release button causes simultaneous movement of the normally hidden release button out from engagement with the inwardly curved lip, to release the lid from engagement with the receptacle. The at least one locking catch may also include a rounded upper surface opposite the downwardly facing planar shoulder to facilitate reconnection of the inwardly curved lip over the locking catches when pivoting the lid from the unlocked position to the locked position.

In another aspect of these embodiments, the lid may include an outer housing having a size and shape for select slide-in reception of the receptacle. Here, the receptacle may include a pair of safety tabs outwardly extending therefrom and normally residing forwardly in a pair of respective locking channels formed in the lid when the child-resistant container is in the locked position. The locking channels may also be in slideable relation with a pair of respective rearly positioned and relatively larger release channels. In these embodiments, the lid may include a spring that biases the receptacle into a forward position within the lid to locate the safety tabs into the respective locking channels. When in this locked position, a front end of the receptacle may protrude out from within the lid. To this end, the lid may also include a notch exposing a relatively larger surface area of the receptacle for enhanced hand manipulation re pull-out removal. When aligned with the release channels in the lid from at least partial compression of the spring with the receptacle, the safety tabs may pivot between a normal vertical position extending out from within the lid and a folded position adjacent a sidewall of the receptacle and within an interior of the lid, thereby permitting slide-out removal of the receptacle from the lid.

In another embodiment, the child-resistant container as disclosed herein may be made from a metal material selected from the group consisting of steel, aluminum, or a metal alloy and include a receptacle having an inner cavity, a lid that selectively pivots relative to the receptacle about a hinge to enclose the inner cavity and substantially prevent access to the inner cavity when in a locked position, and a lock that includes a spring that normally biases a catch and an integrally formed release button into a forward position outwardly extending from the receptacle. The catch may include a shoulder normally hidden when engaged the lid when in the locked position. The release button may be inwardly depressible against the spring to simultaneously move the catch out from engagement with the lid to an unlocked position permitting the lid to move relative to the receptacle to expose access to the inner cavity. To this end, opening the lid relative to the receptacle may expose the normally hidden catch.

In another aspect of this embodiment, the lock may be disposed within the inner cavity and a food-grade protective sheath may be disposed over an inner surface of the inner cavity and include an indent having a size and shape to accommodate the lock thereunder. Moreover, at least one sidewall of the receptacle may include an annular shoulder vertically extending upwardly from a base and transitioning at an inwardly projecting step to an interiorly located upper rim having a wall thickness relatively smaller than the annular shoulder. Here, the inwardly projecting step may have a size and shape to receive a downwardly extending annular skirt of the lid in seated reception thereof when the child-resistant container is in the locked position. As such, the downwardly extending annular skirt may encompass the upper rim when in seated reception on the inwardly projecting step. In another aspect of this embodiment, the catch may include a rounded upper surface opposite a downwardly facing planar shoulder to facilitate locking and unlocking.

In another embodiment, the child-resistant container may include a receptacle having an inner cavity, a lid forming an outer housing having a size and shape for select slide-in reception of the receptacle to enclose the inner cavity when in a locked position, and a lock including a safety tab outwardly extending from the receptacle and normally residing forwardly in a locking channel formed in the lid when the child-resistant container is in the locked position, to substantially prevent access to the inner cavity. Here, a spring in the form of a foam pad located within the lid may bias the receptacle into a forward position within the lid to locate the safety tab into a locking channel. When in the locked position, a front end of the receptacle may protrude out from the lid and include a notch therein to expose a relatively larger surface area of the receptacle for enhanced hand manipulation.

The safety tab may be in slidable relation with the locking channel and a rearly positioned and relatively larger release channel. As such, the safety tab may be movable out from within the locking channel to an unlocked position permitting slide-out removal of the receptacle from the lid to expose access to the inner cavity. More specifically in this respect, when aligned with the release channel in the lid from at least partial compression of the spring with the receptacle, the safety tab may pivot between a normal vertical position extending out from within the lid and a folded position adjacent a sidewall of the receptacle and within an interior of the lid, thereby permitting slide-out removal of the receptacle from the lid.

Other features and advantages of the present invention will become apparent from the following more detailed description, when taken in conjunction with the accompanying drawings, which illustrate, by way of example, the principles of the invention.

BRIEF DESCRIPTION OF THE DRAWINGS

The accompanying drawings illustrate the invention. In such drawings.

DETAILED DESCRIPTION OF THE PREFERRED EMBODIMENTS

Figure 1:
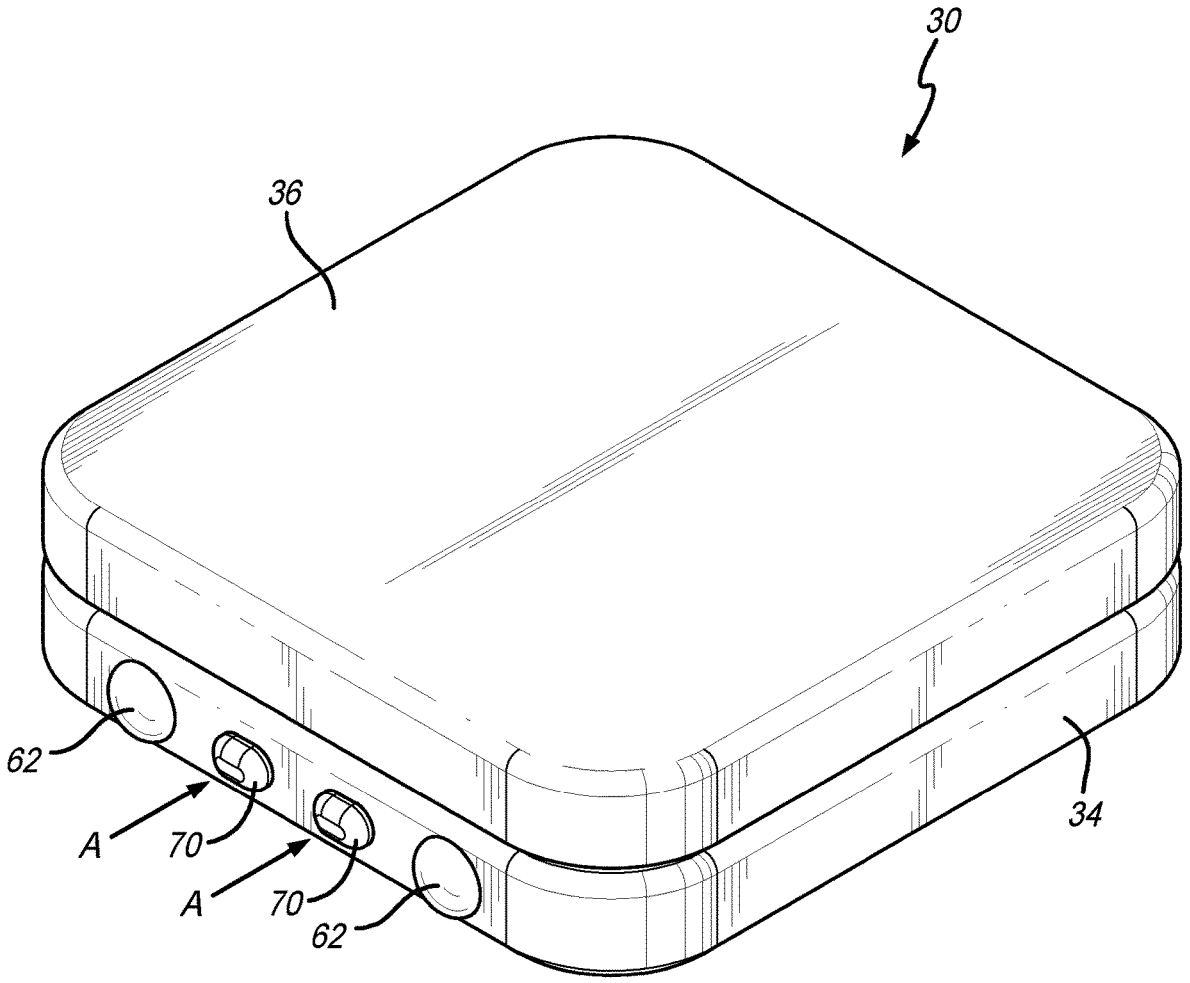
FIG. 1 is a perspective view illustrating a front, top and right sides of one embodiment of a child-resistant container as disclosed herein, in the form of a child-resistant tin.
Figure 2:
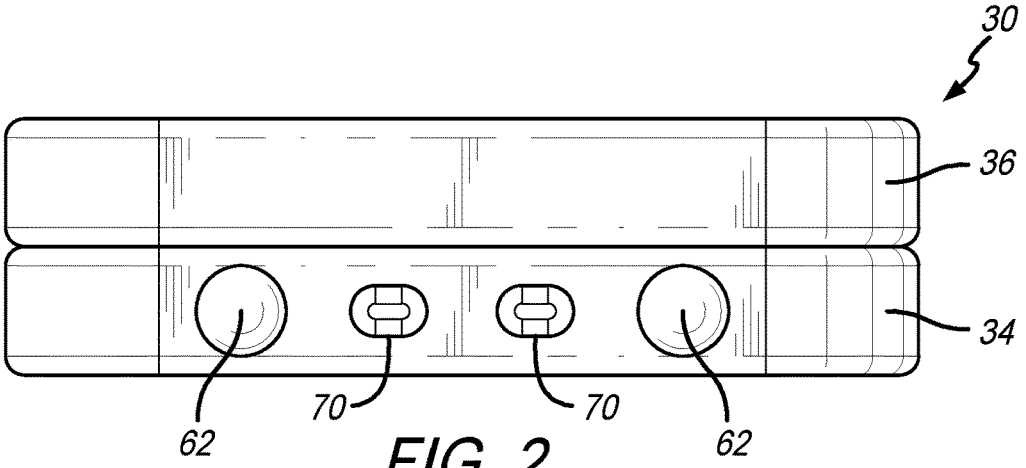
FIG. 2 is a front elevation view of the child-resistant tin of FIG. 1, more specifically illustrating a pair of sidewall mounted release buttons.
Figure 3:
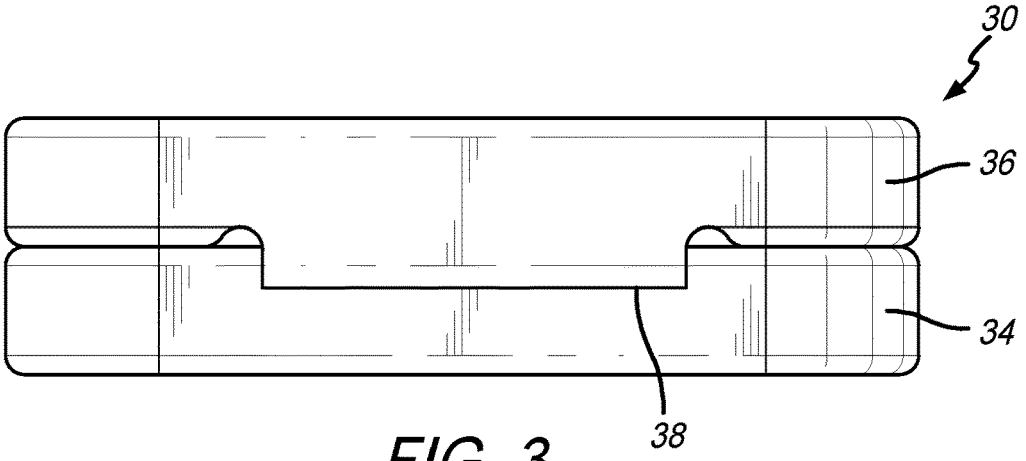
FIG. 3 is a rear elevation view of the child-resistant tin of FIGS. 1-2, more specifically illustrating an upper lid coupled to a lower storage container about a hinge.
Figure 4:
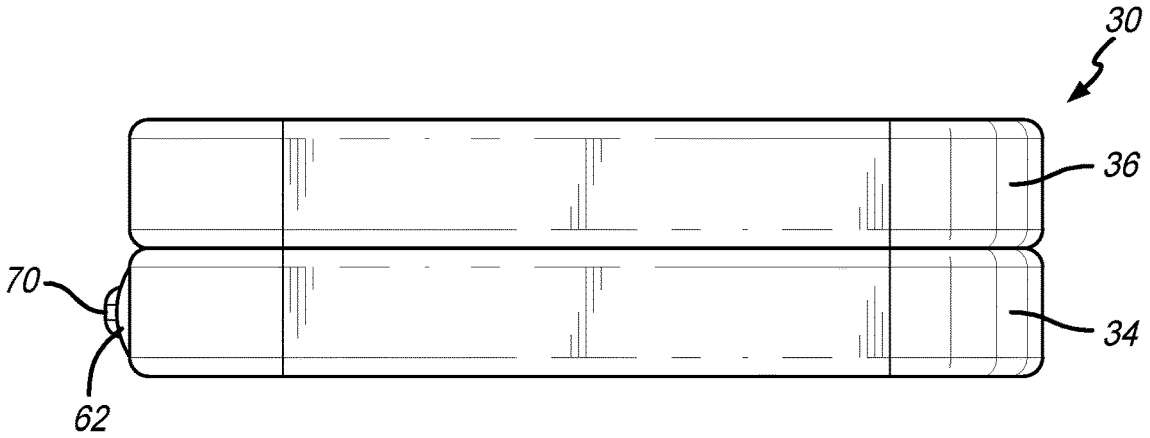
FIG. 4 is a left side elevation view of the child-resistant tin of FIGS. 1-3, illustrating the lid in a closed position.
Figure 5:
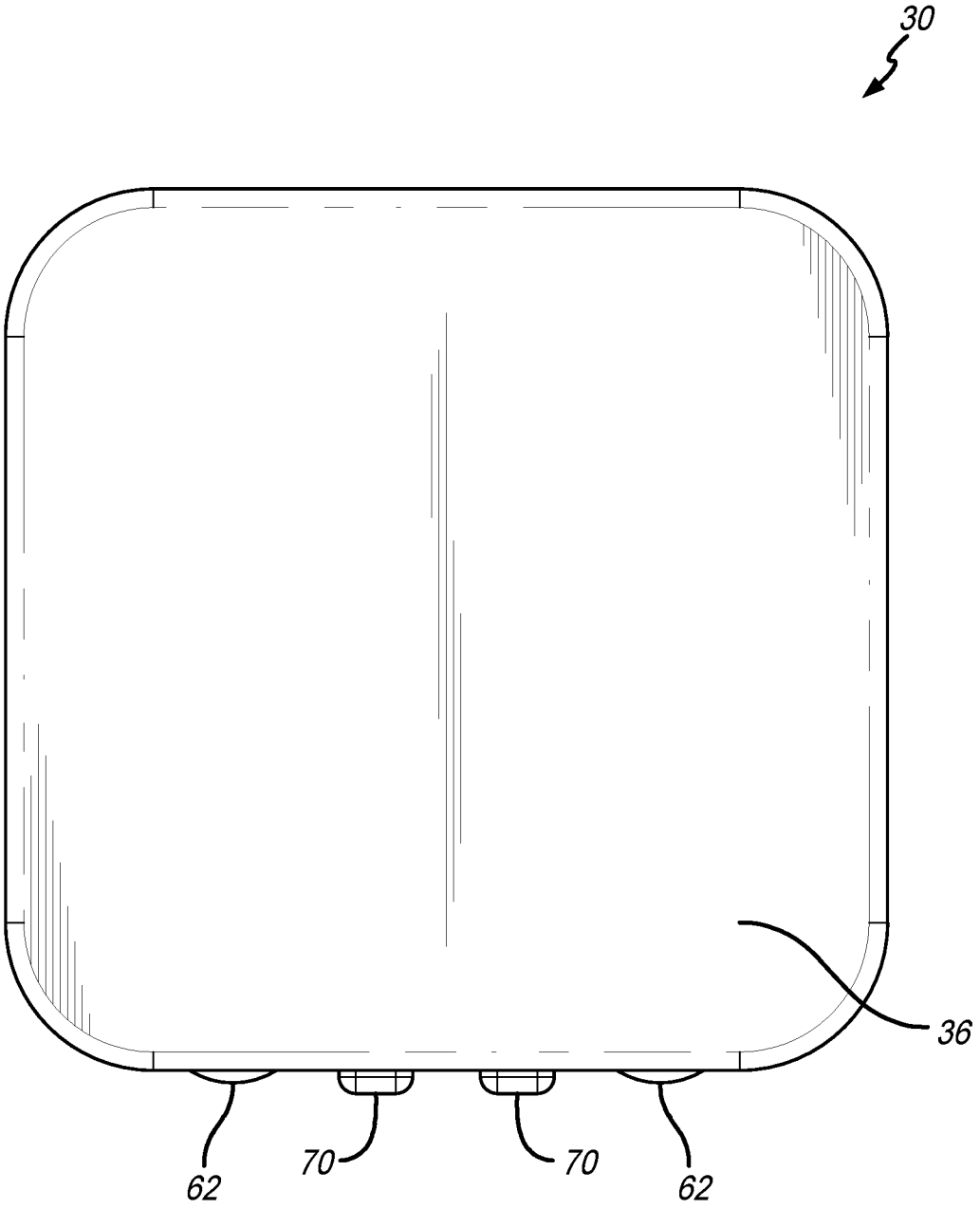
FIG. 5 is a top plan view of the child-resistant tin of FIGS. 1-4 with the lid in the close position.
Figure 6:
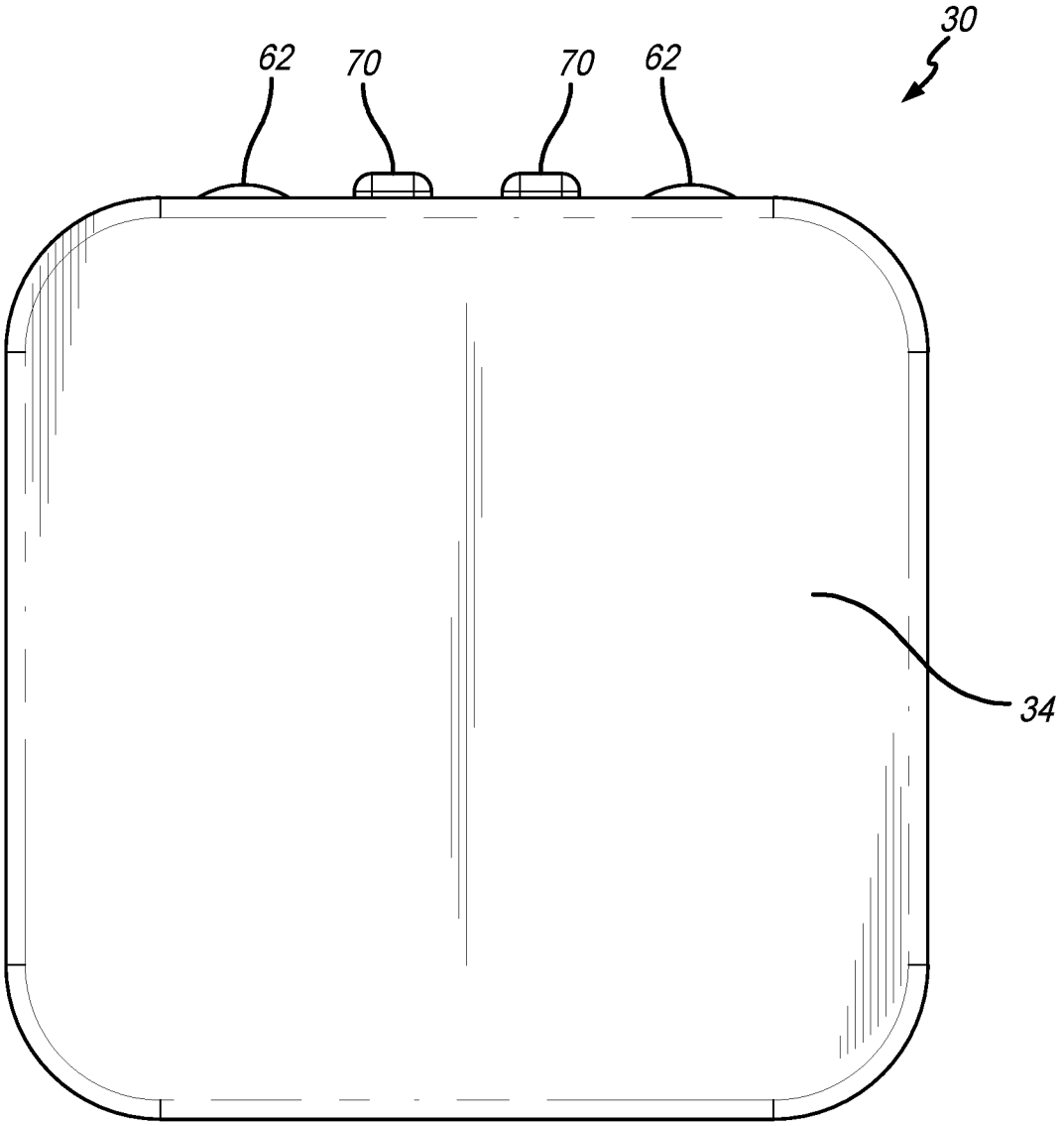
FIG. 6 is a bottom plan view of the child-resistant tin of FIGS. 1-5.
Figure 7:
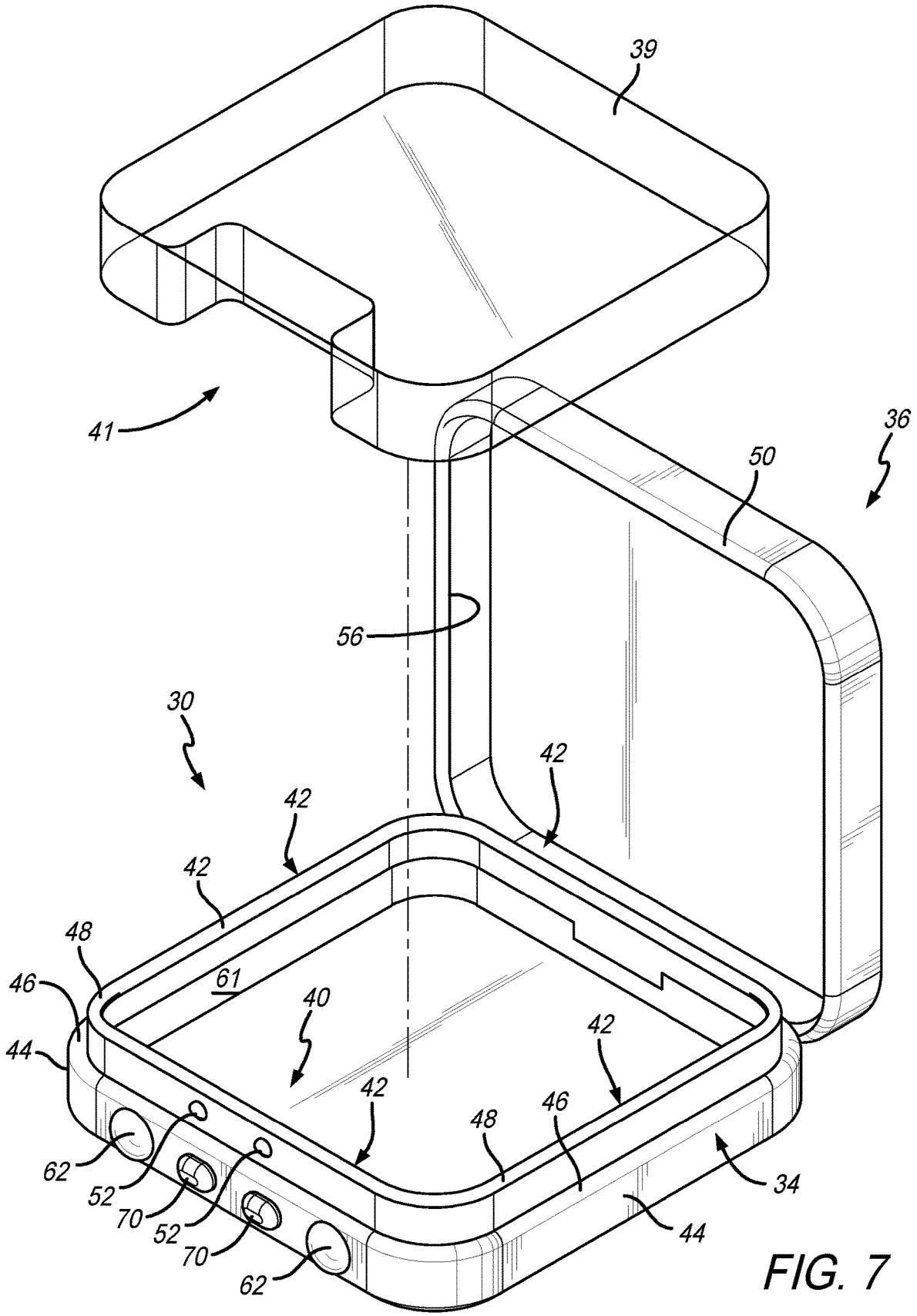
FIG. 7 is a partial exploded perspective view of the child-resistant tin similar to FIG. 1, further illustrating the lid in an open position exposing an inner storage cavity having an inner protective shield.
Figure 8:
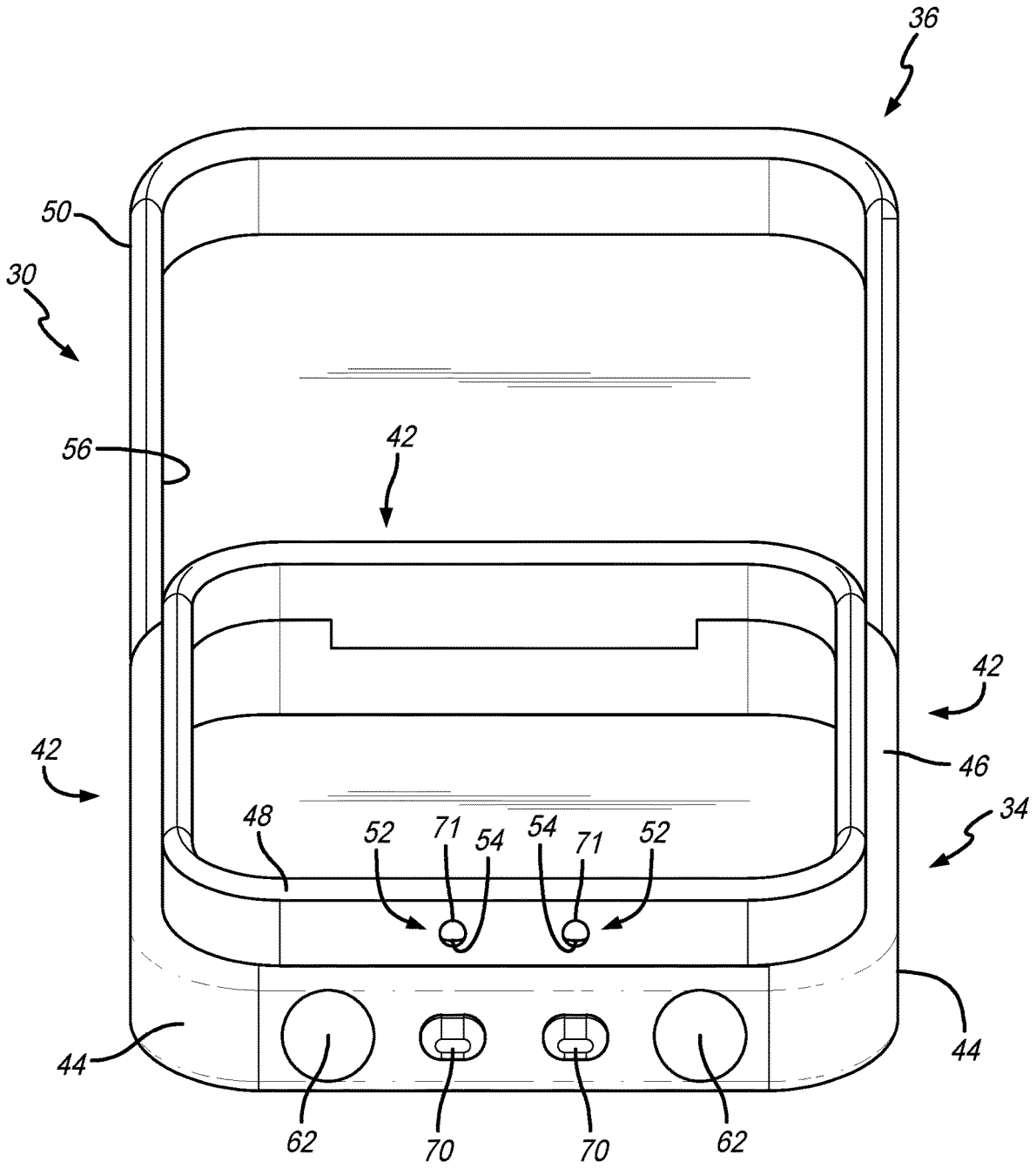
FIG. 8 is a front elevation view of the child-resistant tin similar to FIG. 2 with the lid in the option position, further illustrating a pair of locking catches normally hidden by the lid when in the closed position.
Figure 9:
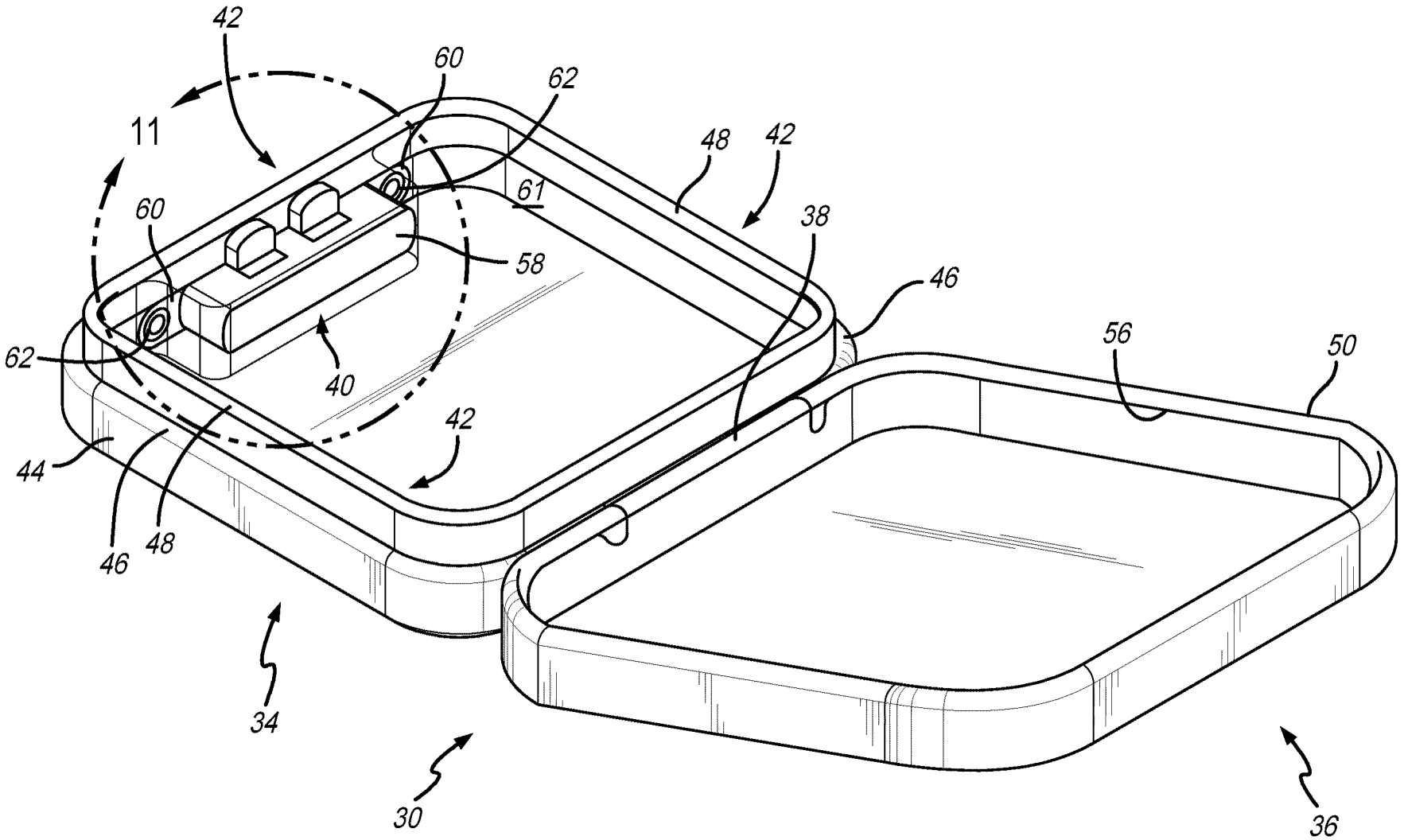
FIG. 9 is a perspective view illustrating a rear, top and right sides of the child-resistant tin with the lid in the open position, further illustrating a lock housing internally mounted within the inner storage cavity and carrying the release buttons and the pair of locking catches.

As shown in the exemplary drawings for purposes of illustration, the present invention for a child-resistant container and/or package is generally illustrated with respect to several embodiments of a child-resistant tin 30, 30',30" in FIGS. 1-12 and 29-44 and with respect to several embodiments of a child-resistant box 32 in FIGS. 13-28. As disclosed in more detail herein, the designs associated with the child-resistant tin 30, 30, 30" and/or the child-resistant box 32 are particularly ideal for both dispensary compliance purposes at the point of sale and for safe home use as an after-purchase product.

In general, the child-resistant tin 30, 30, 30" includes a storage container 34 coupled to a lid 36 about a hinge 38, e.g., as illustrated in FIGS. 1-9 and 29-44. While the storage container 34 and the lid 36 are each generally illustrated in a rectangular shape in FIGS. 1-9 and 29-44, a person of ordinary skill in the art would recognize that the shape may vary (e.g., square, circular, trapezoidal, triangular, etc.). Each of the storage container 34 and the lid 36 are configured for interlocking engagement with one another to house contents therein, such as medical or medicinal products that include *Cannabis* or CBD, including, e.g., food-grade edibles (e.g., gummies, candies, chocolate, etc.). In this respect, the child-resistant tin 30, 30',30" may be made from a metal material such as steel, aluminum, or a related metal alloy material. Alternatively, the child-resistant tin 30, 30', 30" may be made from any food grade material. Additionally, or instead of, the child-resistant tin 30, 30',30" may further include a food-grade protective sheath 39 (FIG. 7) that adheres to or otherwise substantially attaches to an interior surface area of the storage container 34 (FIG. 7) and/or the lid 36. The food-grade protective sheath 39 may provide a buffer between product and the material forming the storage container 34. A locking system 40, 40',40" (best illustrated in FIGS. 9-12, 35, and 43-44) effectively retains the lid 36 in a closed position (FIGS. 1-6, 29-34, and 36-42) relative to the storage container 34 during non-use to ensure safety and general inaccessibility (e.g., by children) of the contents stored therein. In other words, when the child-resistant tin 30, 30',30" is in the closed position, medical products stored within the storage container 34 cannot be easily accessed absent operating the locking system 40, 40',40". In one embodiment, the protective sheath 39 may include a recess or indent 41 to accommodate and protect the operational components of the locking system 40 that may reside within the storage container 34. Of course, the sheath 39 may include more than one recess or indent 41, depending how many of the locking systems 40, 40',40" are incorporated into the child-resistant tin 30, 30',30". [Para 71] As best illustrated in FIGS. 7-9, 35, and 43-44, the storage container 34 may include a series of interconnected side walls 42 that include a lower annular shoulder 44 vertically extending upwardly that transitions at an inwardly projecting step 46 to an interiorly located upper rim 48 having a wall thickness relatively smaller than that of the lower annular shoulder 44. The formation of the annular shoulder 44, the step 46, and the upper rim 48 facilitates select landed and secured reception of the lid 36 onto the storage container 34. More specifically, the lid 36 includes a downwardly extending annular skirt 50 having a reciprocal size and shape of the void formed by the reduced wall thickness of the upper rim 48 relative to the annular shoulder 44 at the step 46. This allows the annular skirt 50 to land on the step 46 in adjacent relation to the upper rim 48 to prevent side-to-side movement of the lid 36 relative to the storage container 34 when in the closed position illustrated in FIGS. 1-6, 29-34, and 36-42. Accordingly, when in this position, the annular skirt 50 generally encompasses the upper rim 48 to lock the contents (e.g., medical or food products, including, e.g., medicated gummies) inside. In FIGS. 1-9, locking engagement of the tin 30 may be accomplished, e.g., by locking the lid 36 relative to the storage container 34 by way of a pair of locking catches 52 having a respective set of downwardly facing planar shoulders 54 designed to catch or otherwise sufficiently engage or retain an inwardly curved lip 56 of the annular skirt 50. Alternatively, in FIGS. 29-35, locking engagement of the tin 30' may be accomplished, e.g., by locking the lid 36 relative to the storage container 34 with a trio of the locking catches 52 having a respective set of downwardly facing planar shoulders 54 (best illustrated in FIG. 12) designed to catch or otherwise sufficiently engage or retain the inwardly curved lip 56 of the annular skirt 50. In another alternative embodiment as illustrated in FIGS. 36-44, locking engagement of the tin 30" may be accomplished, e.g., by locking the lid 36 relative to the storage container 34 with the combination of a pair of the locking systems 40, 40" formed in adjacent side walls of the storage container 34, as discussed in more detail below.

Figure 10:
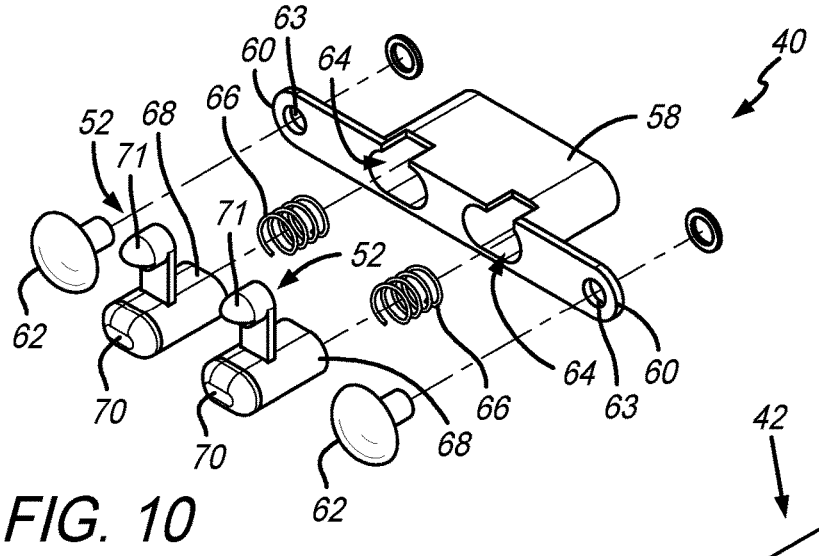
FIG. 10 is an exploded perspective view more specifically illustrating the locking system.
Figure 11:
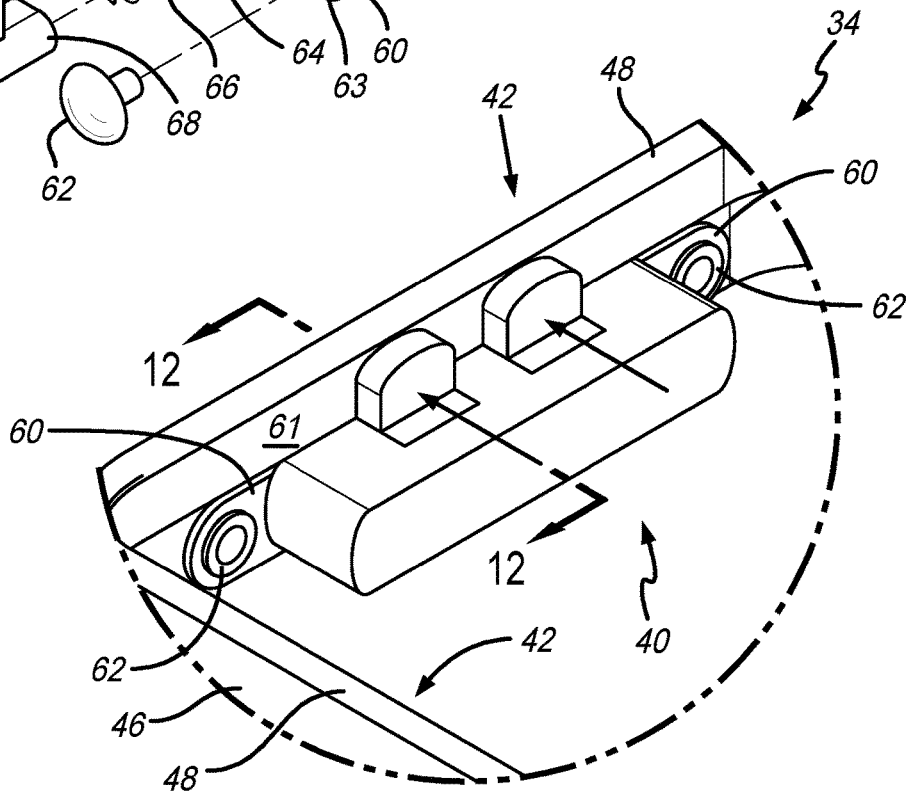
FIG. 11 is an enlarged perspective view taken about the circle 11 in FIG. 9, more specifically illustrating the locking system mounted to a sidewall of the storage container.
Figure 12:
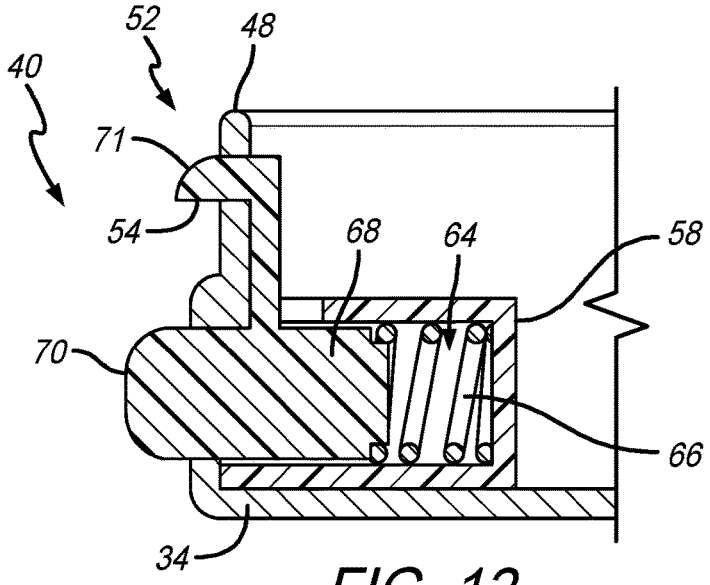
FIG. 12 is a cross-sectional view of the locking system taken about the line 12-12 in FIG. 11, further illustrating a spring-biased slide block within an interior channel of the housing.
Figure 13:
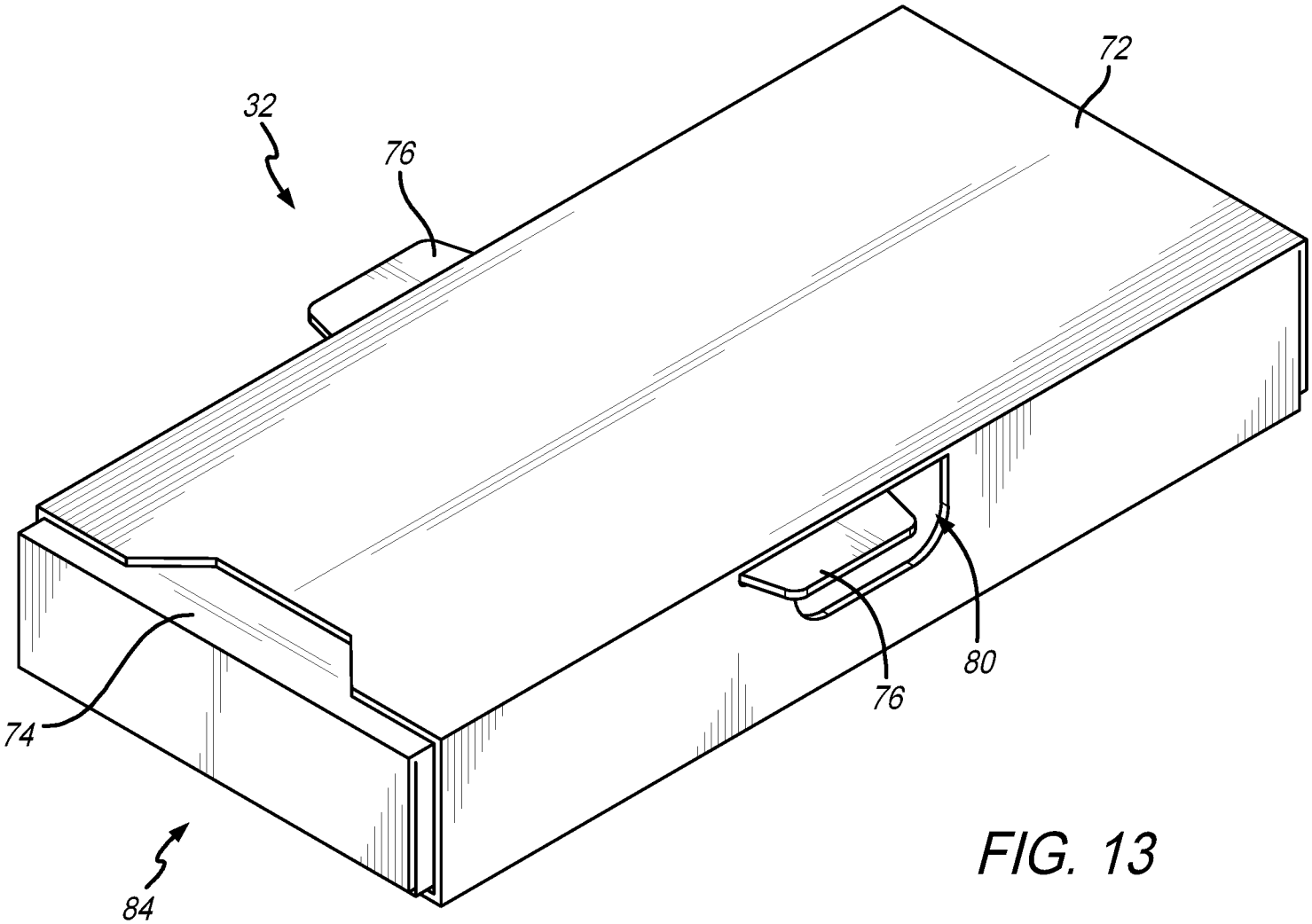
FIG. 13 is a perspective view illustrating a front, top and left sides of another embodiment of a child-resistant container as disclosed herein, in the form of a child-resistant box.
Figure 14:
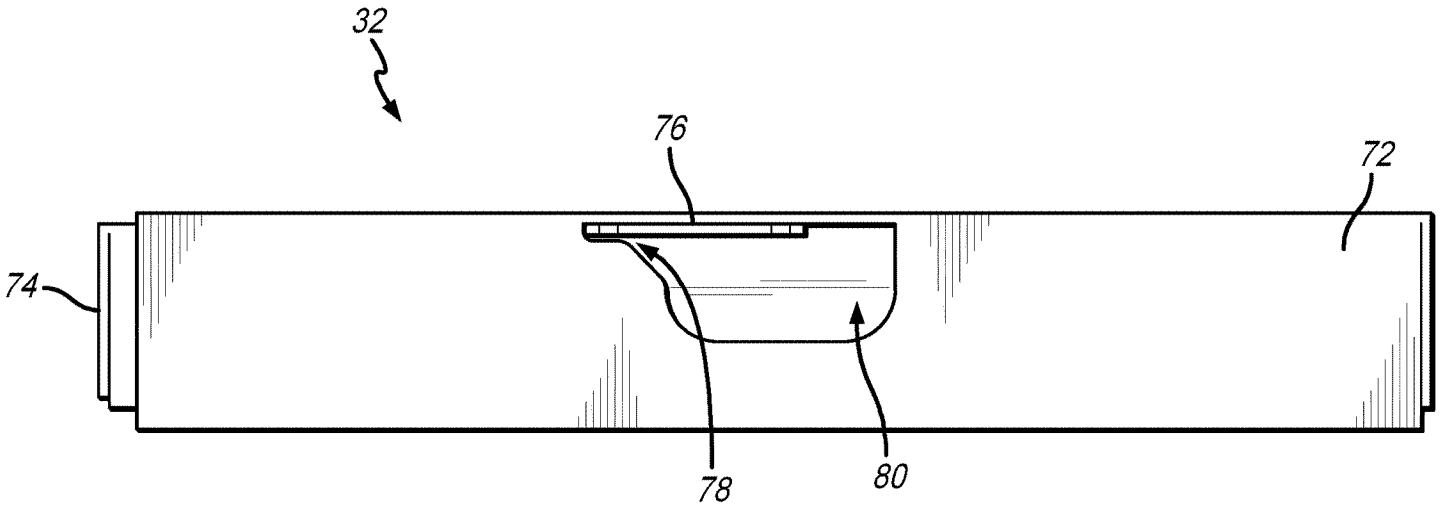
FIG. 14 is a front elevation view of the child-resistant box of FIG. 13, further illustrating one of a pair of safety tabs residing within one of a pair of respective locking channels.
Figure 15:
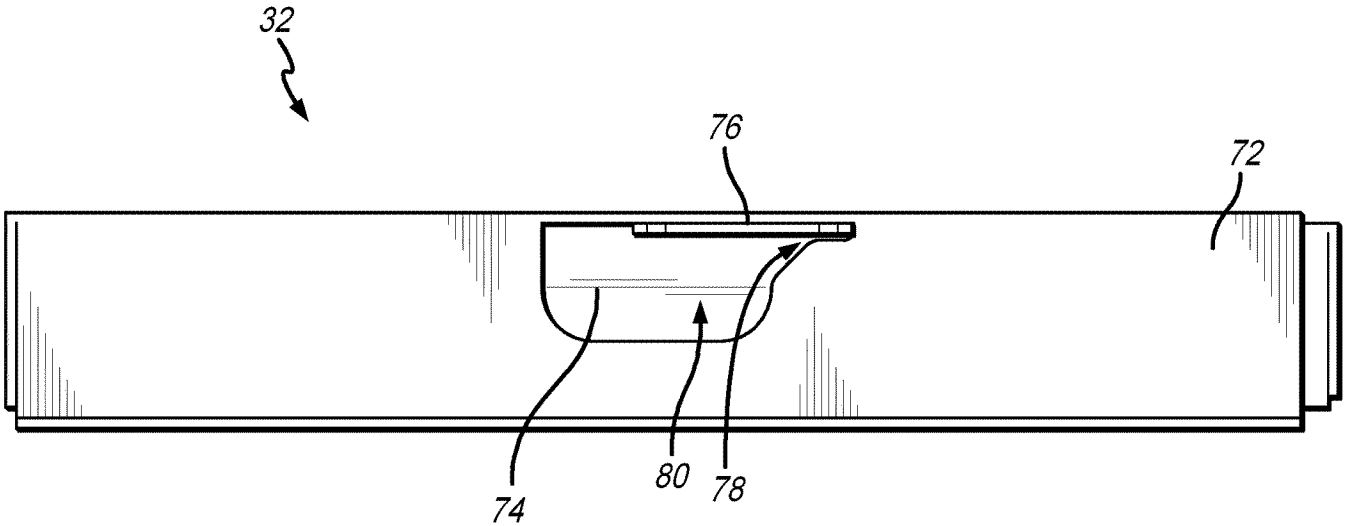
FIG. 15 is a rear elevation view of the child-resistant box of FIGS. 13-14, further illustrating the other of the pair of safety tabs residing within the other of the pair of respective locking channels.
Figure 16:
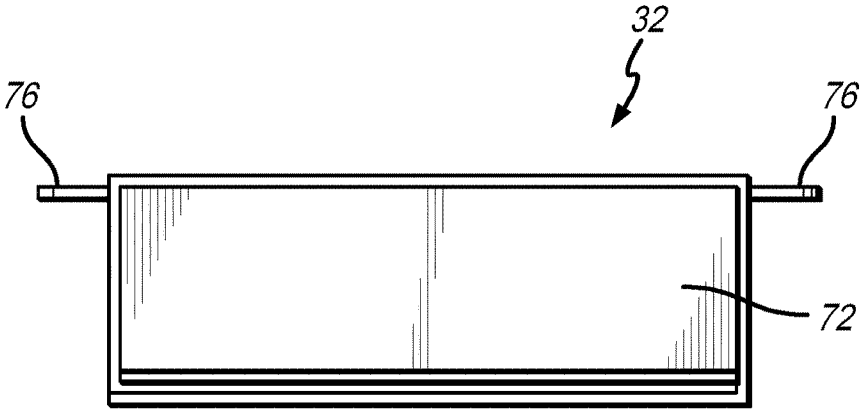
FIG. 16 is a right side elevation view of the child-resistant box of FIGS. 13-15, further illustrating each of the pair of safety tabs extending from opposite sides of an outer housing of the child-resistant box.
Figure 17:
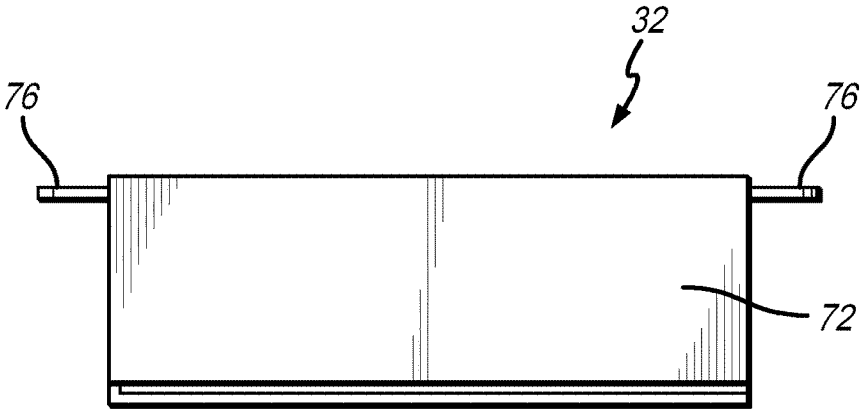
FIG. 17 is a left side elevation view of the child-resistant box of FIGS. 13-16.
Figure 18:
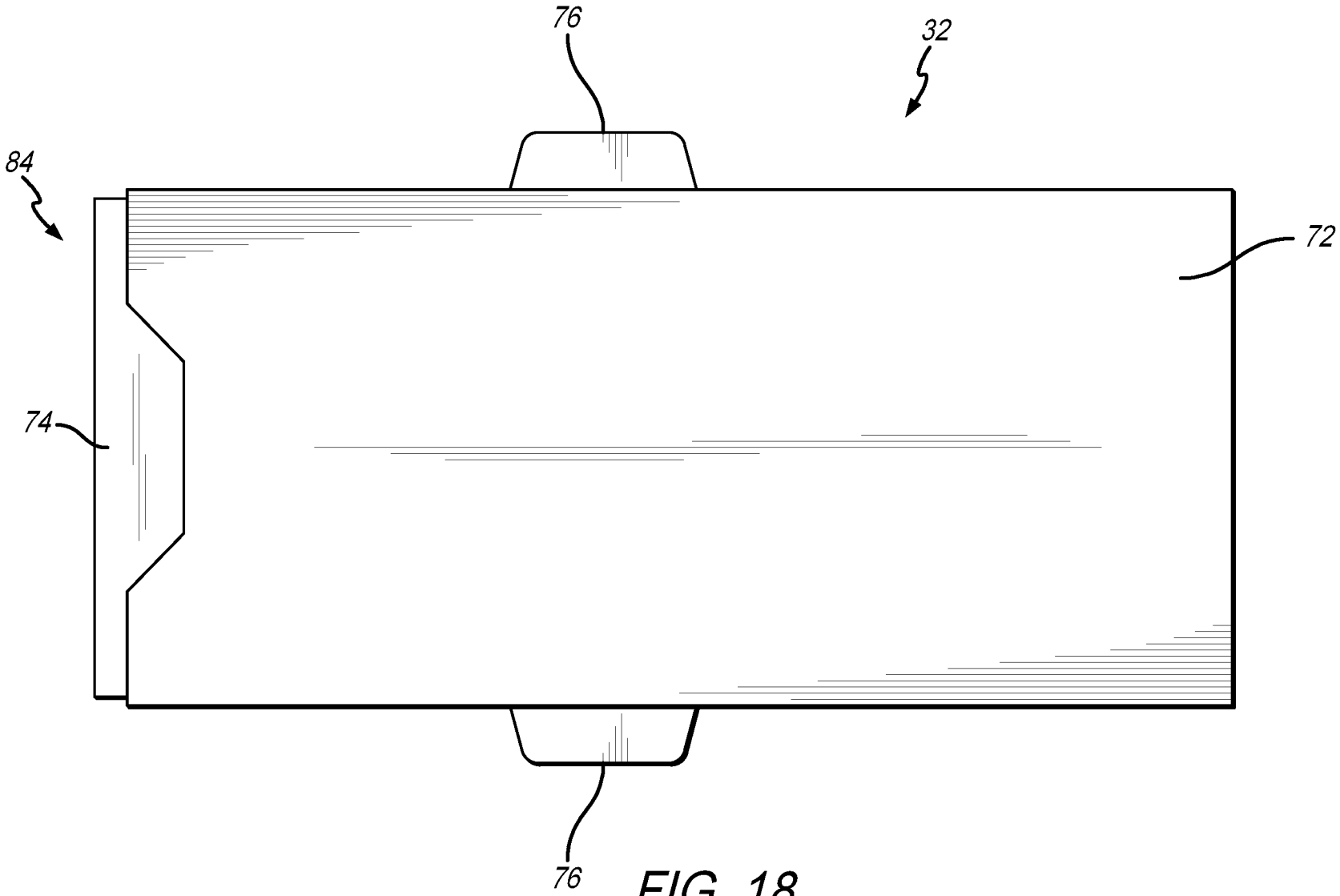
FIG. 18 is a top plan view of the child-resistant box of FIGS. 13-17.
Figure 19:
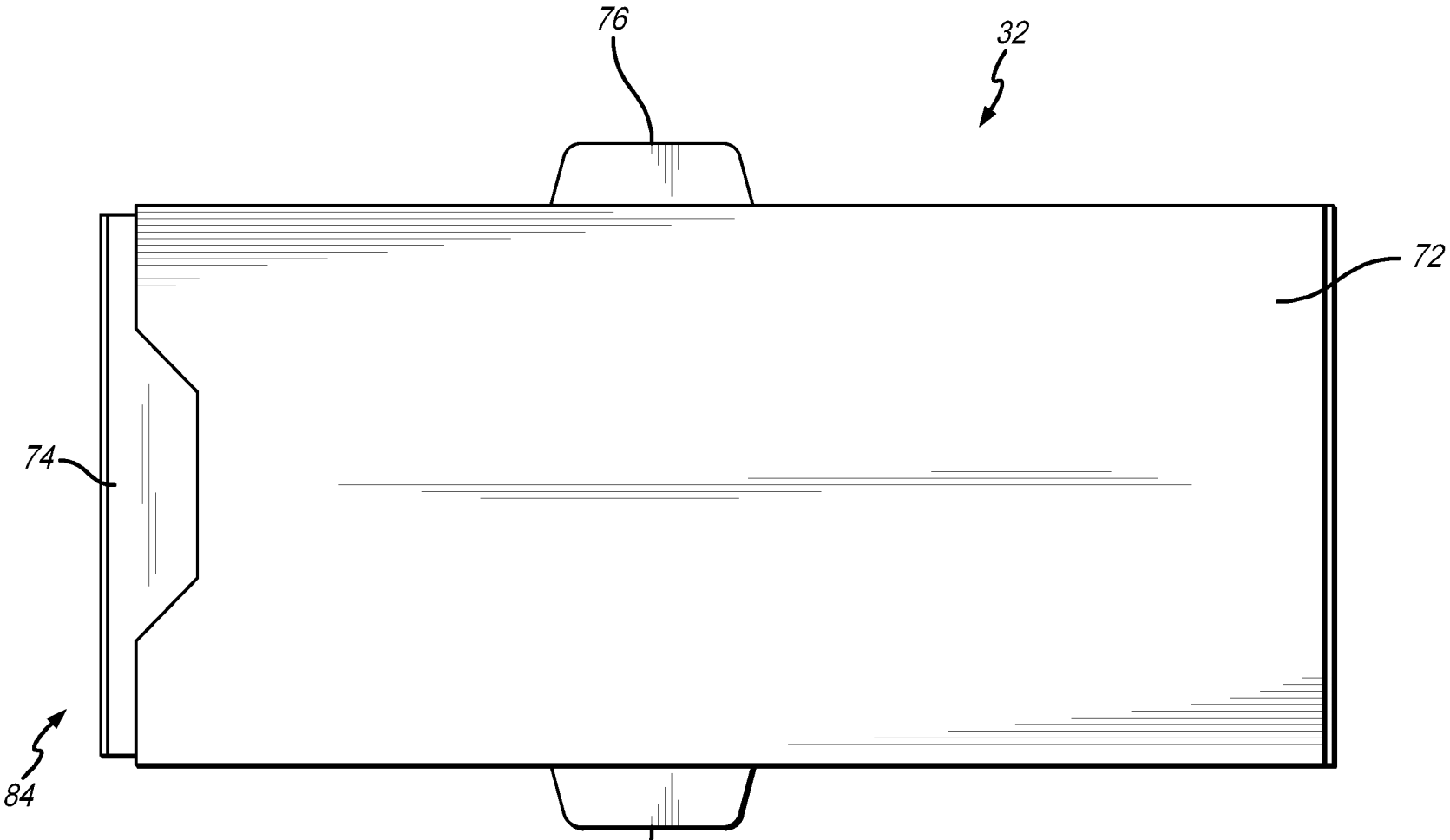
FIG. 19 is a bottom plan view of the child-resistant box of FIGS. 13-18.

FIGS. 10-12 illustrate an exemplary construction of the locking systems 40, 40',40", and specifically with respect to the locking system 40. Specifically, the locking systems 40, 40',40" may include a housing 58 forming a general boxlike structure with a pair of mounting wings 60 outwardly projecting from each side and configured for flush engagement with an inner surface 61 of one of the side walls 42 of the storage container 34 (e.g., as best illustrated in FIG. 11). A pair of mounting bolts 62 may be configured to extend through a respective pair of apertures 63 (best illustrated in FIG. 10) formed in each of the mounting wings 60 for attachment of the locking systems 40, 40',40" to one of the vertical or upstanding sidewalls 42 of the storage container 34. In this respect, the exploded perspective view of FIG. 10 and the cross-sectional view of FIG. 12 illustrate that the housing 58 may include one or more interior channels 64 housing one or more springs 66 that abut a respective rear slide block 68 generally integrally formed with the outwardly extending locking catch 52 and a respective release button 70.

Specifically with respect to the locking system 40, FIGS. 10-12 illustrate a pair of the locking catches 52, a pair of the downwardly facing planar shoulders 54, a pair of the interior channels 64, a pair of the springs 66, a pair of the slide blocks 68, and a pair of the release buttons 70. Although, the locking system may include more of each, such as three of the locking catches 52, three of the downwardly facing planar shoulders 54, three of the interior channels 64, three of the springs 66, three of the slide blocks 68, and three of the release buttons 70 as illustrated in FIGS. 29-35 with respect to the locking system 40'. This latter embodiment may enhance security by increasing the required dexterity to operate all three of the release buttons 70 simultaneously, in order to open the child-resistant tin 30'.

In another alternative as illustrated in FIGS. 36-44, the locking system 40" may include as few as one of the locking catches 52, one of the downwardly facing planar shoulders 54, one of the interior channels 64, one of the springs 66, one of the slide blocks 68, and one of the release buttons 70. When used alone, a user would only need to operate one release button 70 to open the lid 36. Although, as illustrated in FIGS. 36-44, the locking system 40" is paired with the locking system 40, which necessarily requires that a user operate both locking systems 40, 40' simultaneously to unlatch the lid 36 from the storage container 34 to gain access to the contents therein. Consequently, this may require even more coordination and/or dexterity, thereby also enhancing security. Of course, one or more of the locking systems 40, 40', 40" may be used alone or in combination with one another, including, e.g., all three locking systems 40, 40',40" used together in a single child-resistant tin; a single child-resistant tin may include multiple of only one of the locking systems 40, 40',40"; or each of the locking systems 40, 40',40" may be mixed and/or matched as needed and/or desired in various child-resistant tin designs.

Figure 29:
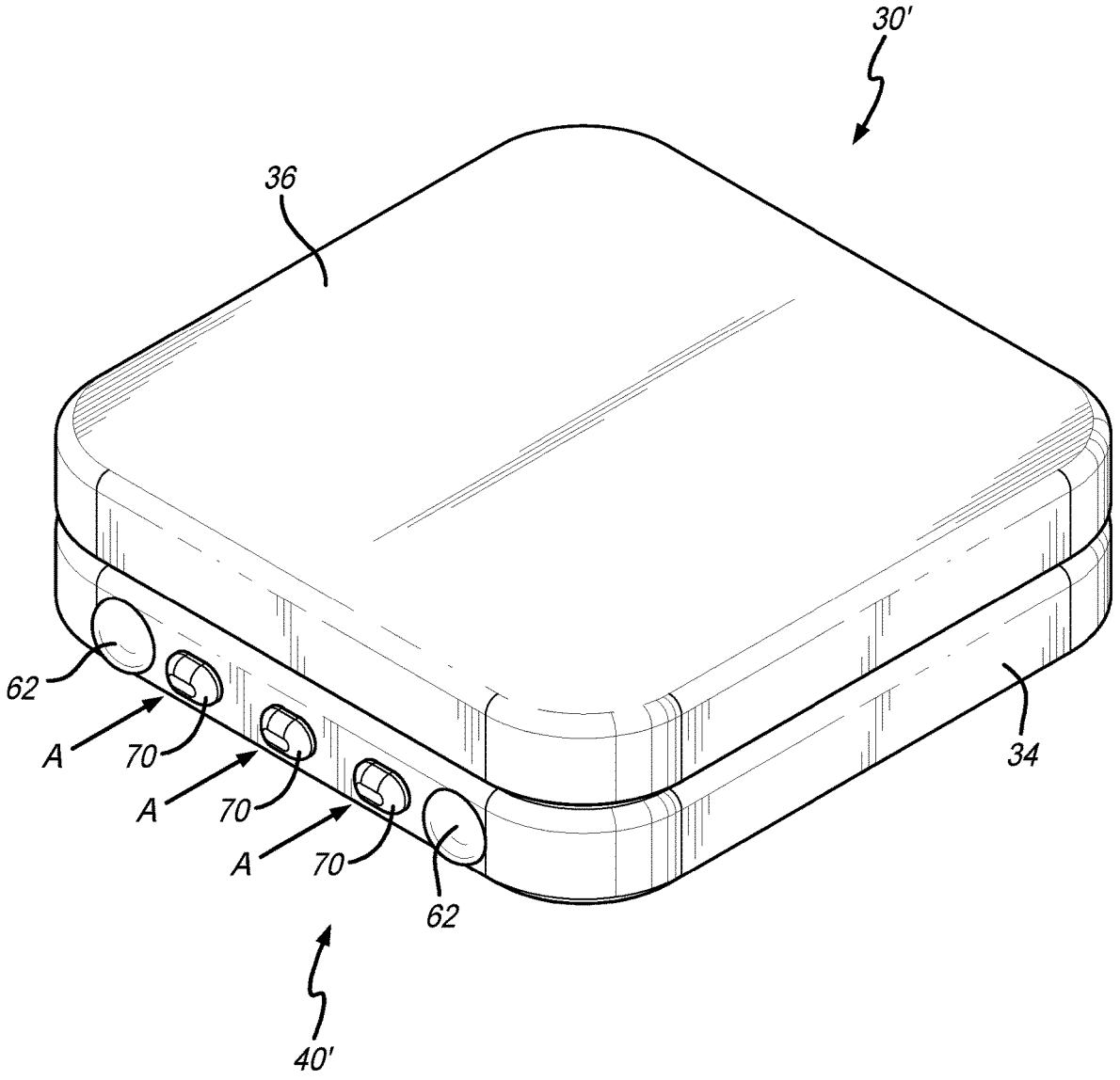
FIG. 29 is a perspective view illustrating an alternative child-resistant tin wherein the locking system includes a set of three release buttons.
Figure 30:
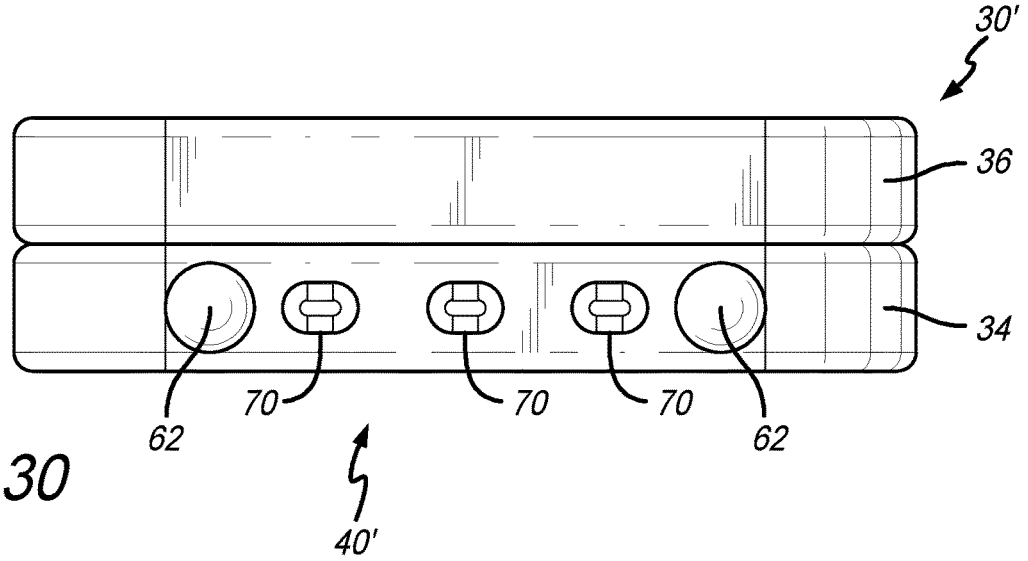
FIG. 30 is a front elevation view of the alternative child-resistant tin of FIG. 29.
Figure 31:
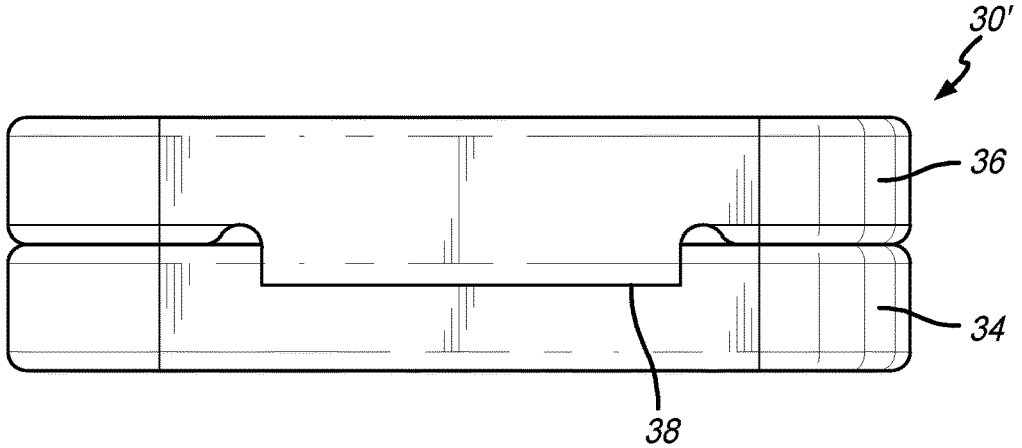
FIG. 31 is a rear elevation view of the alternative child-resistant tin of FIGS. 29 and 30.
Figure 32:
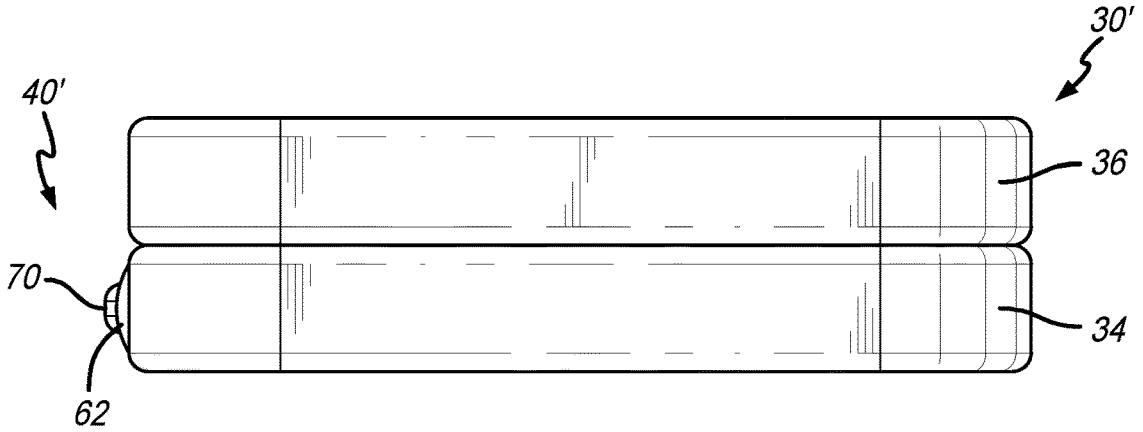
FIG. 32 is a right side elevation view of the alternative child-resistant tin of FIGS. 29-31, the left side elevation view being a mirror image thereof.
Figure 33:
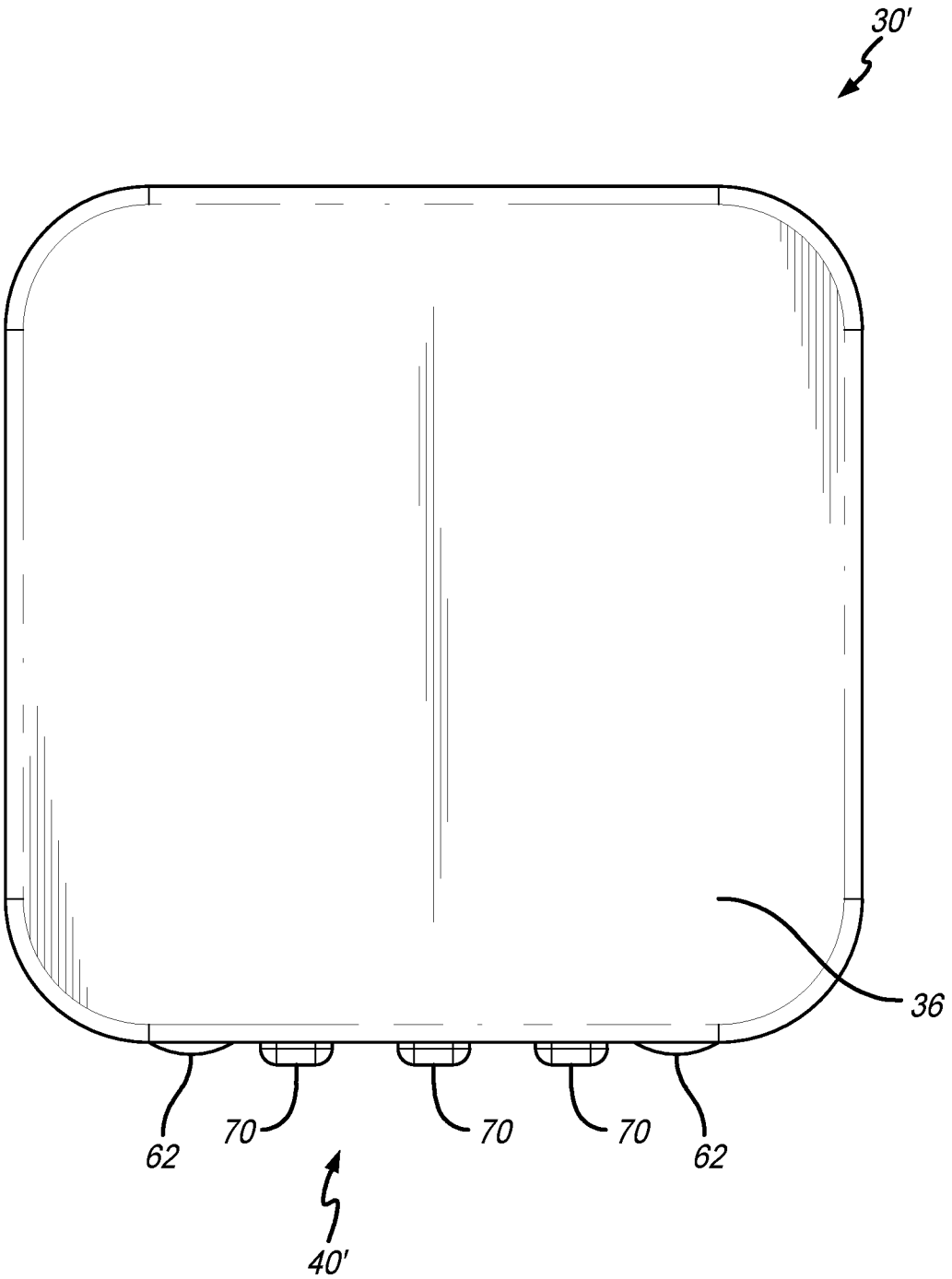
FIG. 33 is a top plan view of the alternative child-resistant tin of FIGS. 29-32.
Figure 34:
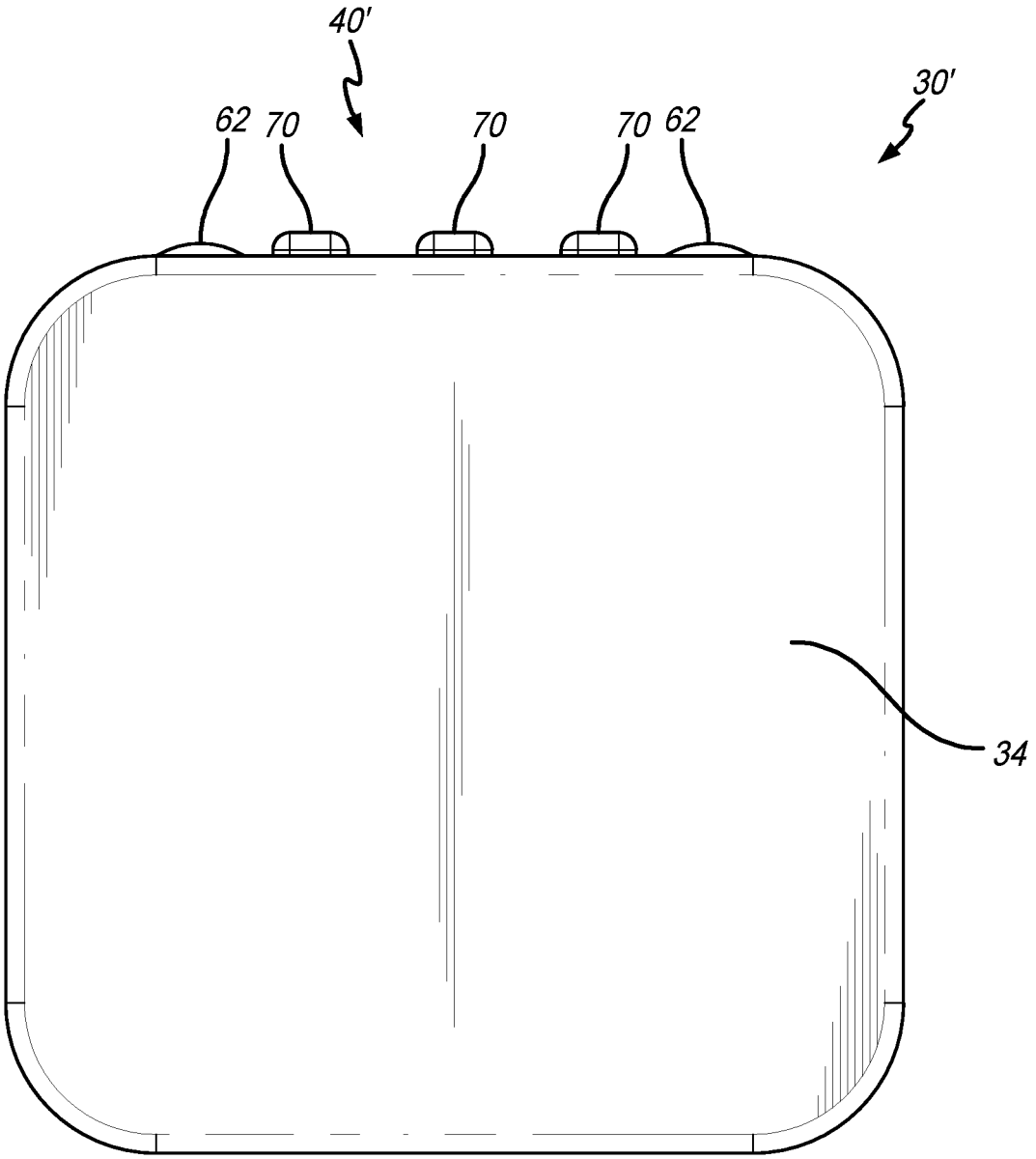
FIG. 34 is a bottom plan view of the alternative child-resistant tin of FIGS. 29-33.
Figure 35:
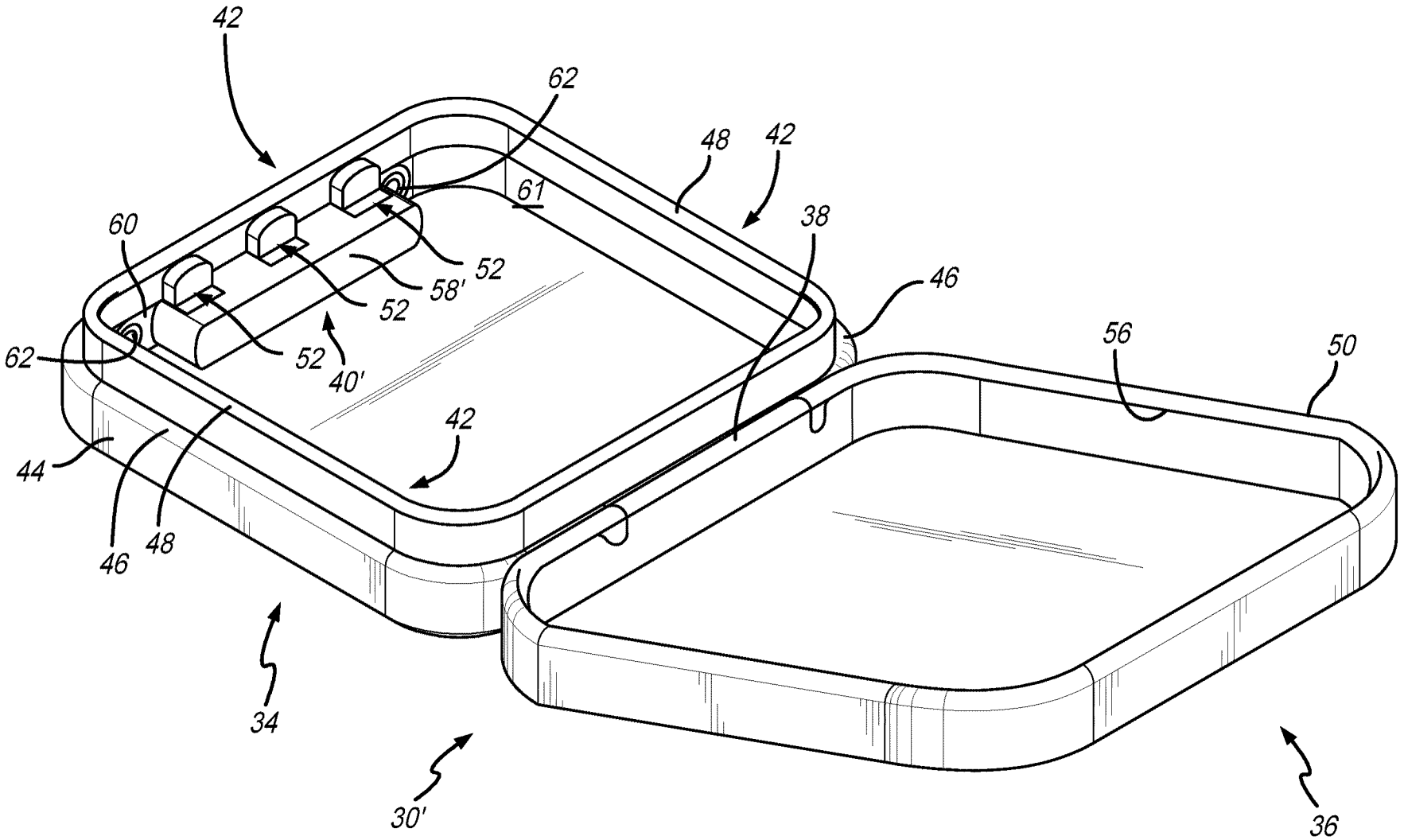
FIG. 35 is a perspective view illustrating a rear, top and right sides of the alternative child-resistant tin of FIGS. 29-34 with the lid in an open position, further illustrating the lock housing internally mounted within the inner storage cavity and carrying the set of three release buttons within a housing.
Figure 36:
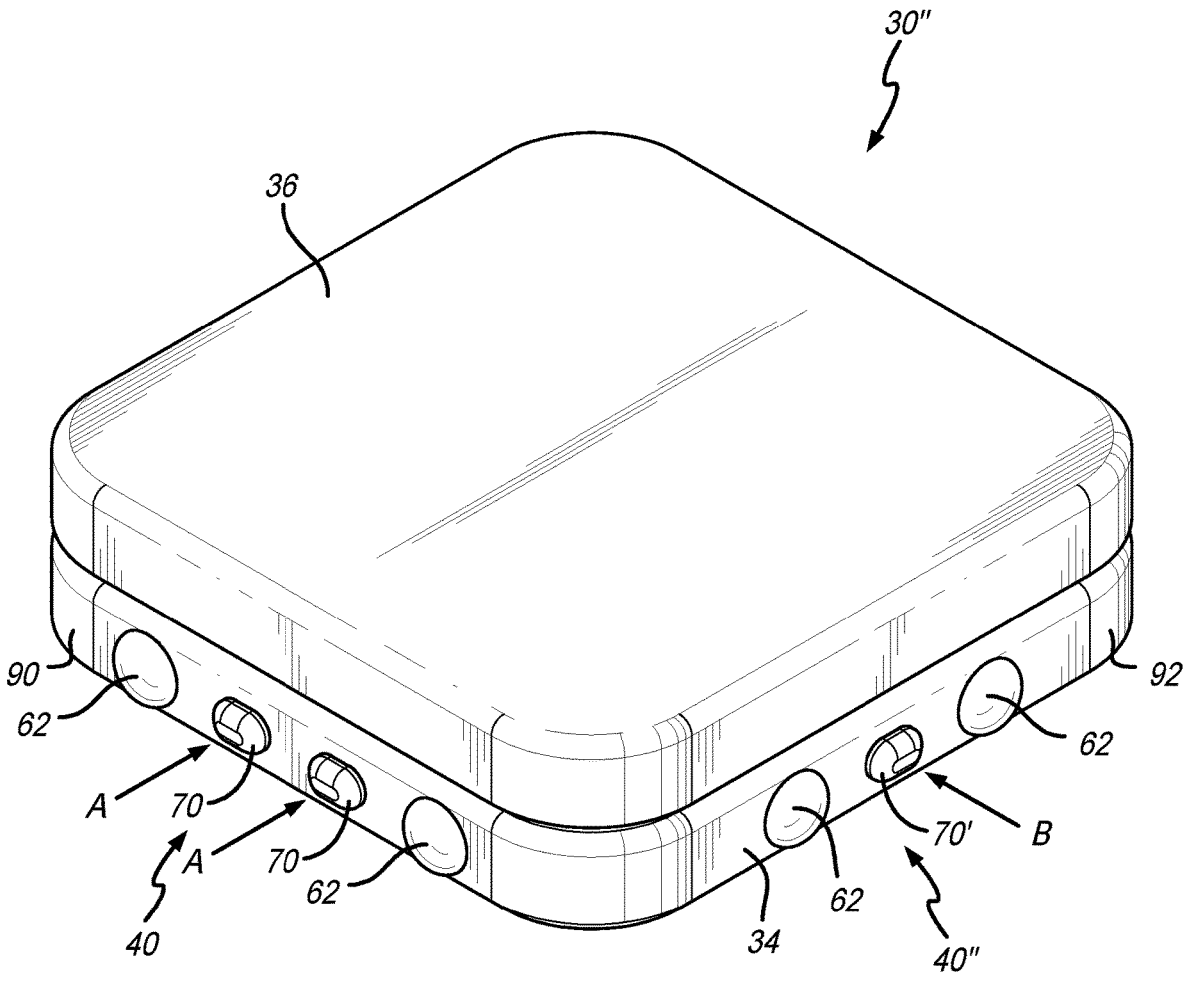
FIG. 36 is a perspective view illustrating another alternative child-resistant tin including a pair of independently operable locking systems on adjacent sidewalls.
Figure 37:
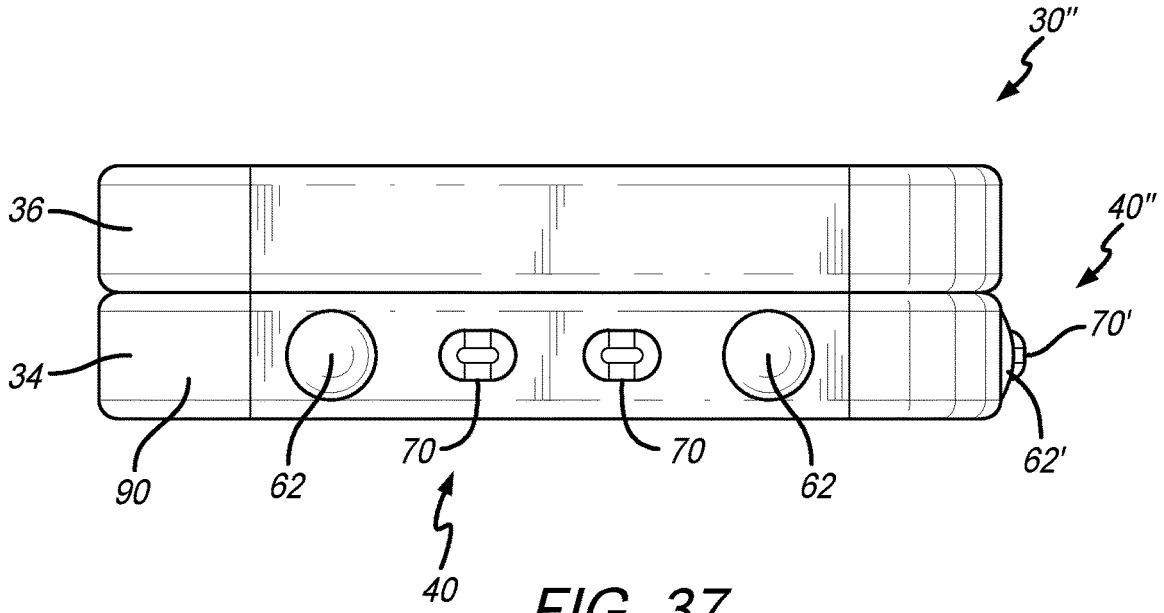
FIG. 37 is a front elevation view of the alternative child-resistant tin of FIG. 36.
Figure 38:
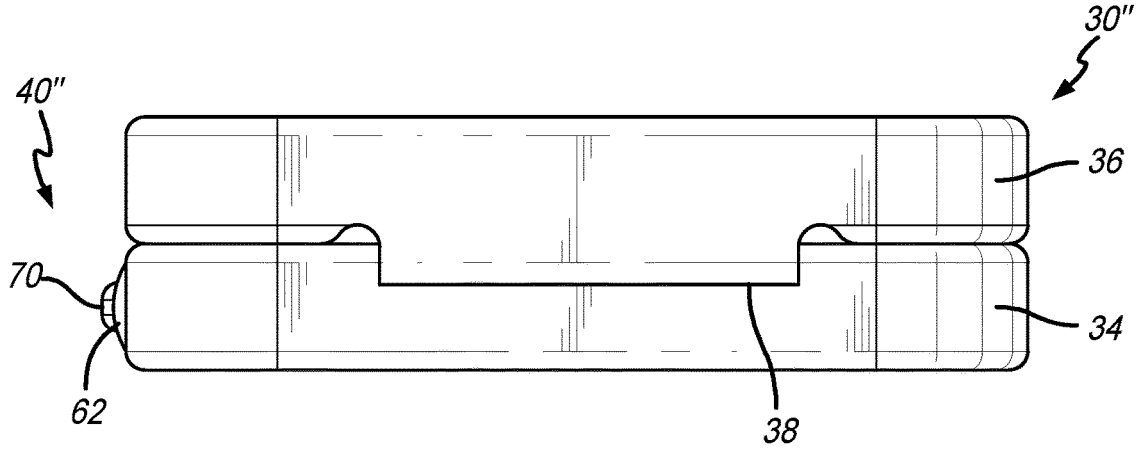
FIG. 38 is a rear elevation view of the alternative child-resistant tin of FIGS. 36 and 37.
Figure 39:
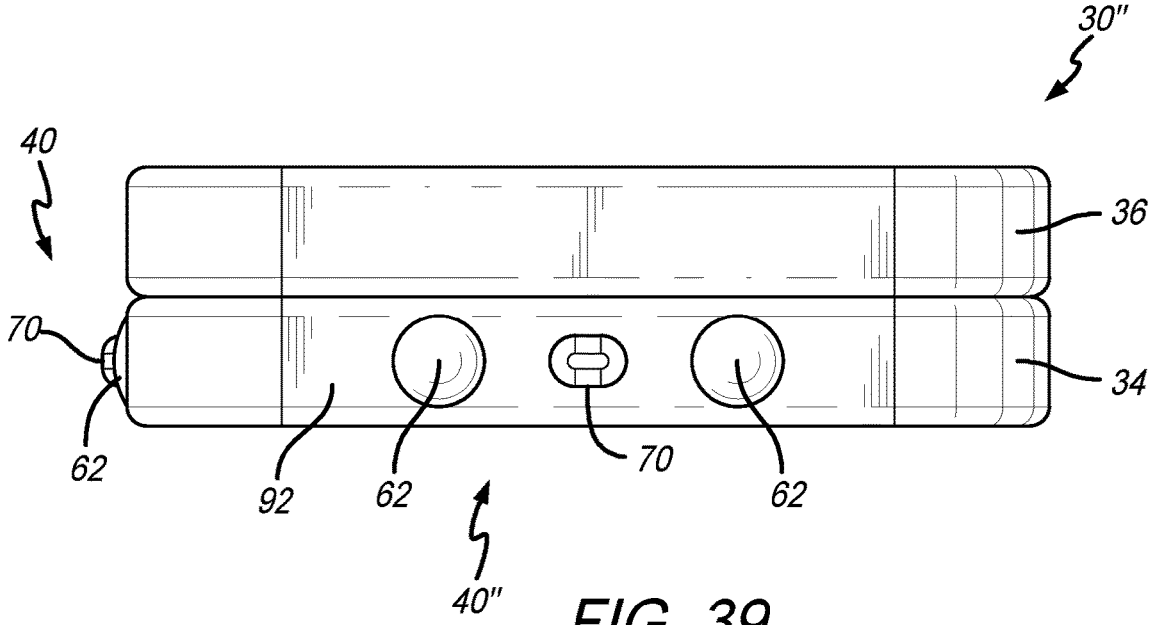
FIG. 39 is a right side elevation view of the alternative child-resistant tin of FIGS. 36-38.
Figure 40:
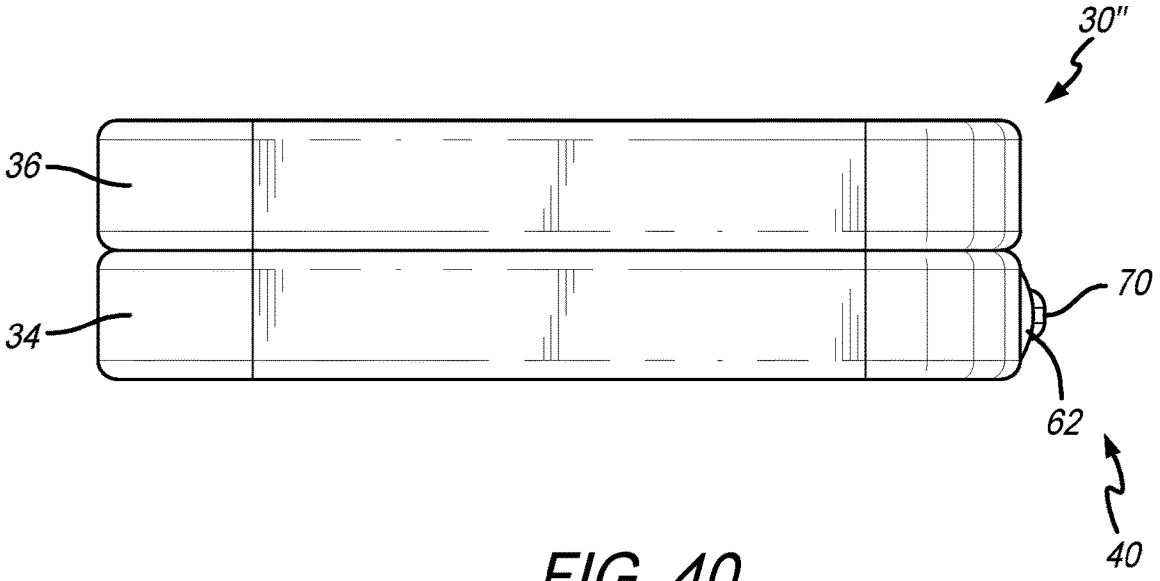
FIG. 40 is a left side elevation view of the alternative child-resistant tin of FIGS. 36-39.
Figure 41:
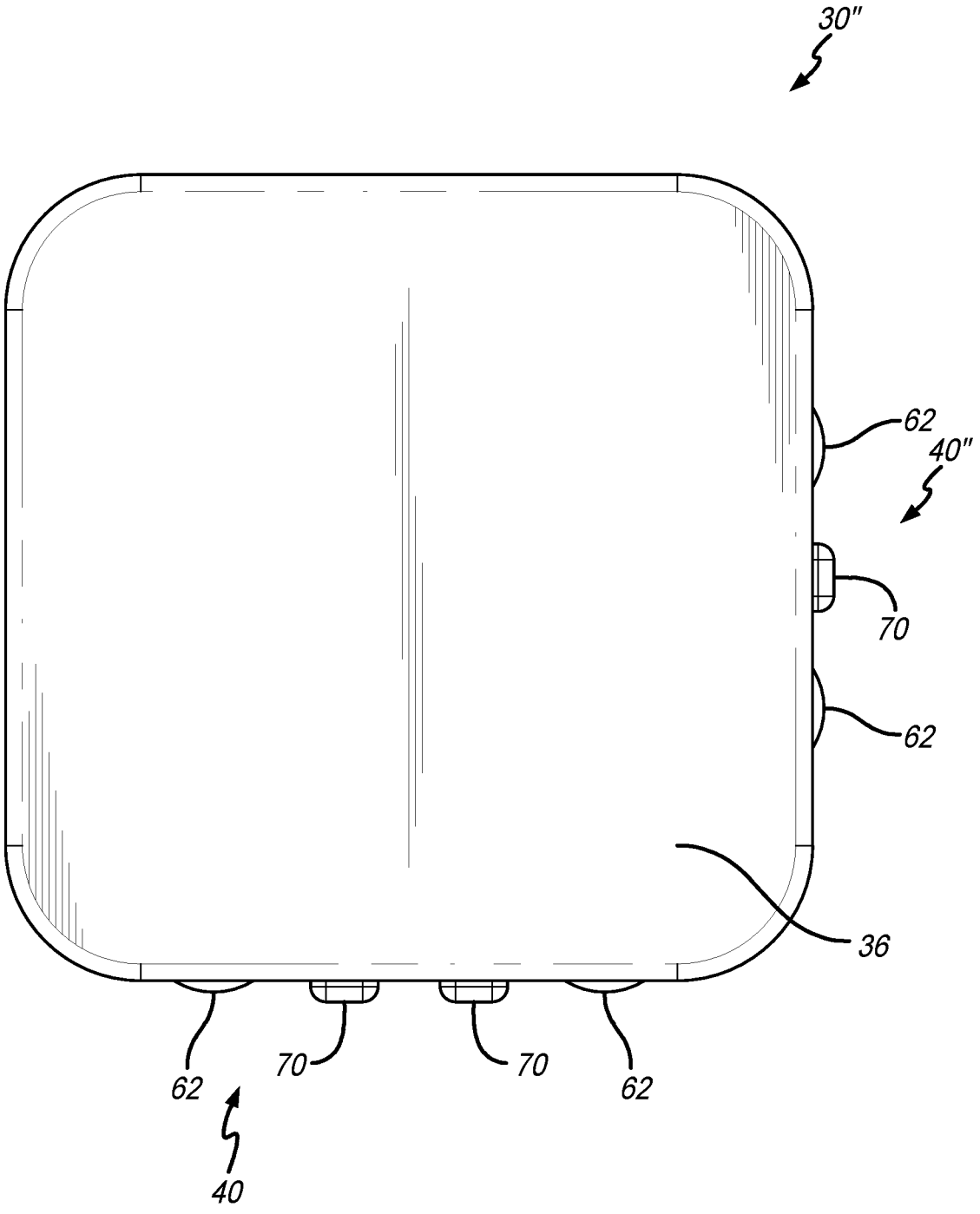
FIG. 41 is a top plan view of the alternative child-resistant tin of FIGS. 36-40.
Figure 42:
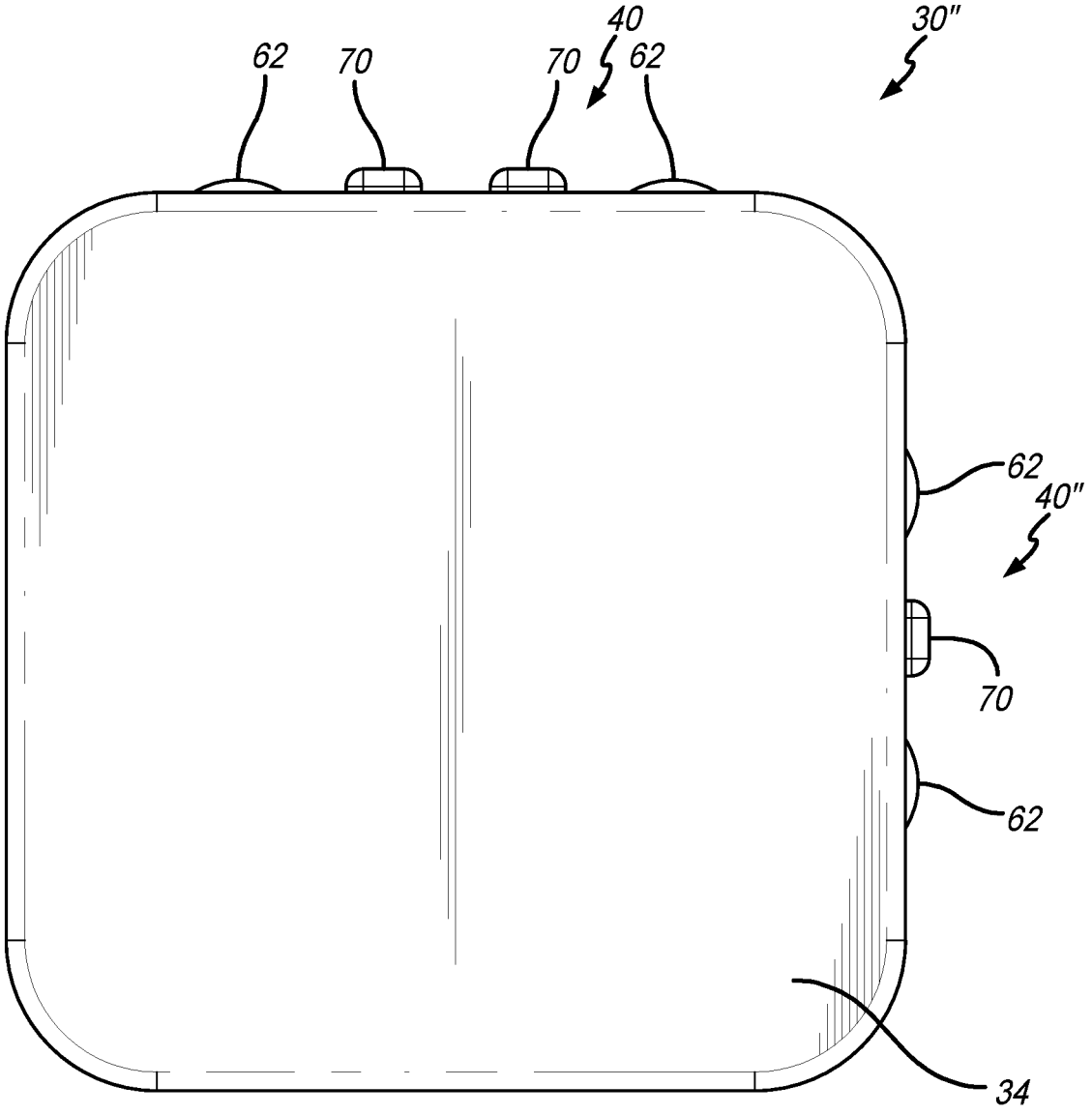
FIG. 42 is a bottom plan view of the alternative child-resistant tin of FIGS. 36-41.
Figure 43:
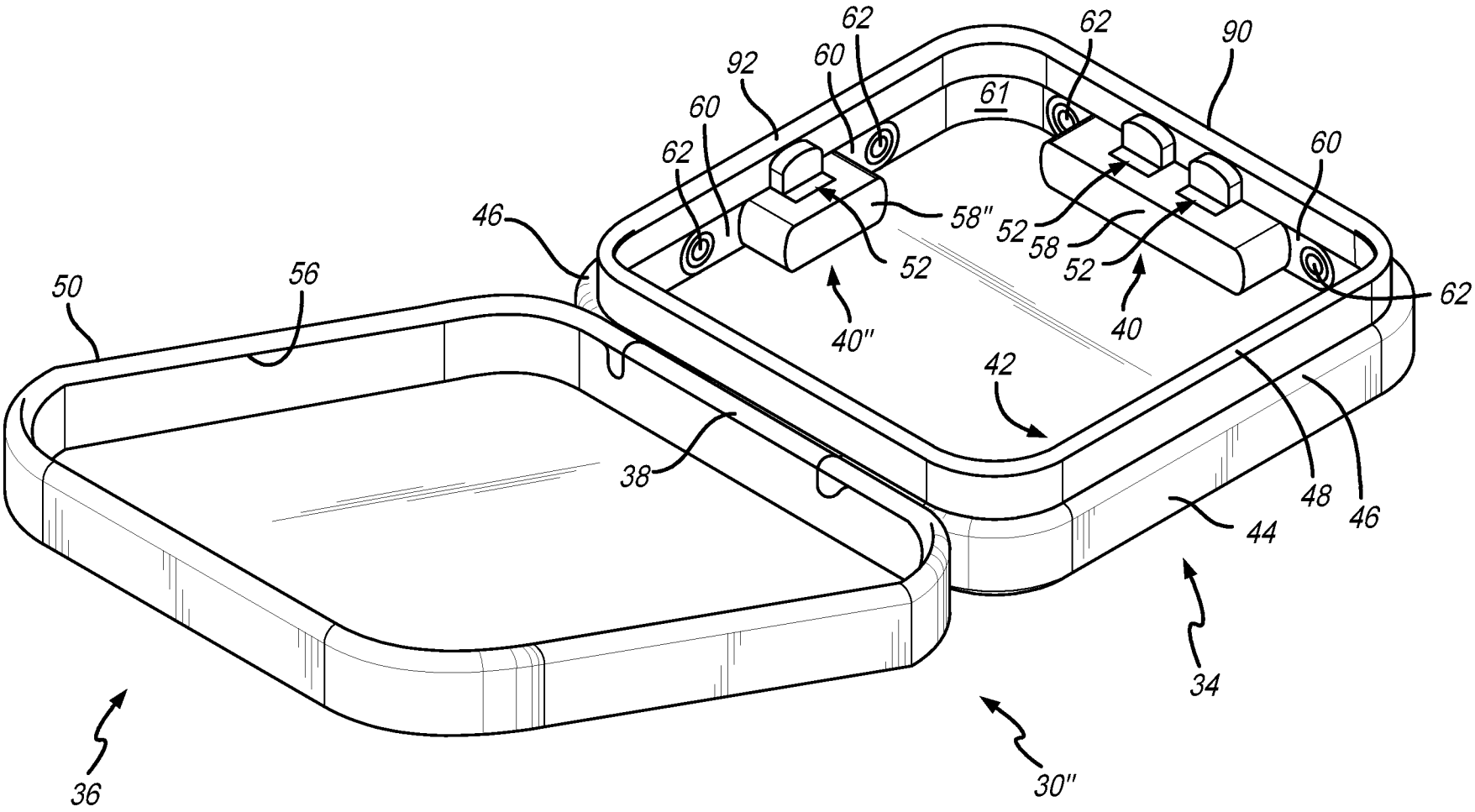
FIG. 43 is a perspective view illustrating a rear, top, and left sides of the alternative child-resistant tin of FIGS. 36-42 with the lid in an open position, and further illustrating the pair of independently operable locking systems mounted within the inner storage cavity on adjacent sidewalls thereof.
Figure 44:
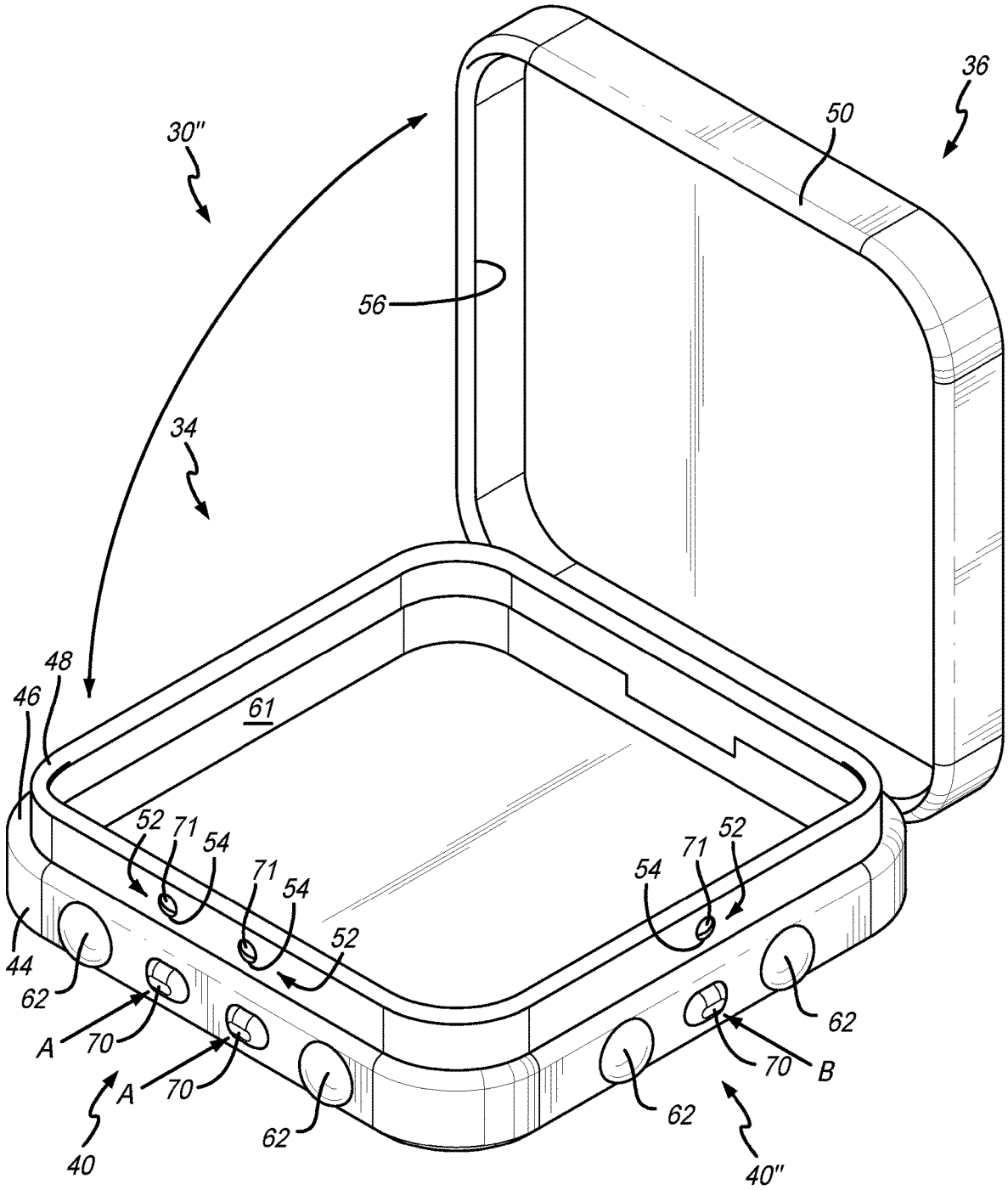
FIG. 44 is a perspective view illustrating a front, top and right sides of the alternative child-resistant tin o FIGS. 36-43, further illustrating simultaneous operation of the pair of independently operable locking systems to open the lid of the tin.

In operation, when the child-resistant tin 30, 30',30" is in the closed position illustrated in FIGS. 1-6, FIGS. 29-34, and FIGS. 36-42, applying a force along each of the directional Arrows A in FIGS. 1 and 29, or along each of the directional Arrows A and B in FIG. 36, facilitates compression of each of the release buttons 70 (and the internally located slide block 68) against the springs 66 within the interior channels 64. Normally, the springs 66 bias the release buttons 70 (and the outwardly extending locking catches 52) in a forward position such that the downwardly facing planar shoulders 54 also extend out from within one of the sidewalls 42 for engagement with the inwardly curved lip 56 of the annular skirt 50. As such, depressing all of the release buttons 70 against the respective springs 66 simultaneously causes each of the locking catches 52 to commensurately move inwardly with the release buttons 70 toward the interior of the storage container 34. In one embodiment, each of the release buttons 70 may move independently of one another, i.e., depression of one release button 70 may only cause disengagement of one of the locking catches 52. In this embodiment, it would be necessary to depress the second and any additional release buttons 70 simultaneously to unlock the lid 36 from the storage container 34. Alternatively, the release buttons 70 may be interconnected such that depression of one of the release buttons 70 effectively operates all release buttons within the housing 58, wherein all of the locking catches 52 may disengage through movement (i.e., depression) of only one of the release buttons 52. Effectively, depressing the release buttons 70 causes the downwardly facing planar shoulders 54 of the locking catches 52 to retract out from a normal outwardly projecting position, e.g., as best shown in FIGS. 12 and 44. When retracted, the downwardly facing planar shoulders 54 no longer provide a surface area sufficient for engagement with the inwardly curved lip 56 of the annular skirt 50 to remain coupled thereto. As a result, the lid 36 is no longer held in the closed position, and can be rotated about the hinge 38 to an open position as generally illustrated in FIGS. 7-9, 35, and 43-44.

Of course, removal of the force along Arrows A in FIG. 1 or 29, or removal of the forces along Arrows A and B in FIGS. 36 and 44, allows the springs 66 to push the release buttons 70 and the locking catches 52 back out beyond the respective side wall 42. Here, closing and locking the child-resistant tin 30, 30',30" may be accomplished by rotating the lid 36 about the hinge 38 such that the annular skirt 50 moves to an adjacent and seated position on the step 46 wherein the annular skirt 50 extends down over the locking catches 52 for engagement therewith by way of the inwardly curved lip 56. Here, the downwardly facing planar shoulders 54 provide sufficient surface area engagement to retain the annular skirt 50 of the lid 36 a closed and locked position. Each of the locking catches 52 may include a rounded or curved/arcuate upper surface 71 to better facilitate sliding movement of the annular skirt 50 over the locking latches 52 for snap-fit engagement up underneath against the downwardly facing planar shoulders 54. When back in the closed position, the lid 36 remains locked to the storage container 34 until the release buttons 70 are again depressed and retracted out from within the housing 58 by a distance sufficient to withdraw the downwardly facing planar shoulders 54 out from engagement with the annular skirt 50. Once disengaged, the contents stored within the interior of the storage container 34 may then be accessed again by pivoting the lid 36 relative to the storage container 34 about the hinge 38.

In another embodiment as disclosed herein with respect to FIGS. 13-28, the child-resistant box 32 may generally include an outer housing 72 having a size and shape to selectively receive and retain an inner storage container 74 therein. When in a normally closed position, e.g., as illustrated in FIGS. 13-19, a pair of safety tabs 76 extend out beyond opposing sides of the outer housing 72 and reside forwardly biased within a locking channel 78 designed as a forward slot to prevent pull out removal of the inner storage container 74 out from within the outer housing 72 when in this normal closed position. Although, the locking channel 78 is in slideable relation with a rearly positioned and relatively larger release channel 80 having a size and shape relatively larger than one of the pair of safety tabs 76. The size and shape of the release channels 80 permit inward folding of each of the safety tabs 76 into the interior of the outer housing 72 for purposes of disengaging the inner storage container 74 from the outer housing 72, to permit removal therefrom as discussed in more detail herein.

Normally, the inner storage container 74 is biased in a forward position as generally illustrated in FIGS. 13-19 with each of the safety tabs 76 firmly located within respective locking channels 78. This ensures that the inner storage container 74 remains locked to the outer housing 72 to prohibit access to contents therein (e.g., medicinal products such as gummies or candies containing CBD) during non-use. The storage container 74 may be generally biased into this forward position by an internally located spring 82, such as the foam insert 82 illustrated in the partial cut-away perspective views of FIGS. 27 and 28. As shown best in FIGS. 13-14 and 18-19, a front end 84 of the inner storage container 74 may extend out from a portion of the outer housing 72 for purposes of hand manipulation to open the inner storage container 74 to access product inside.

Figure 20:
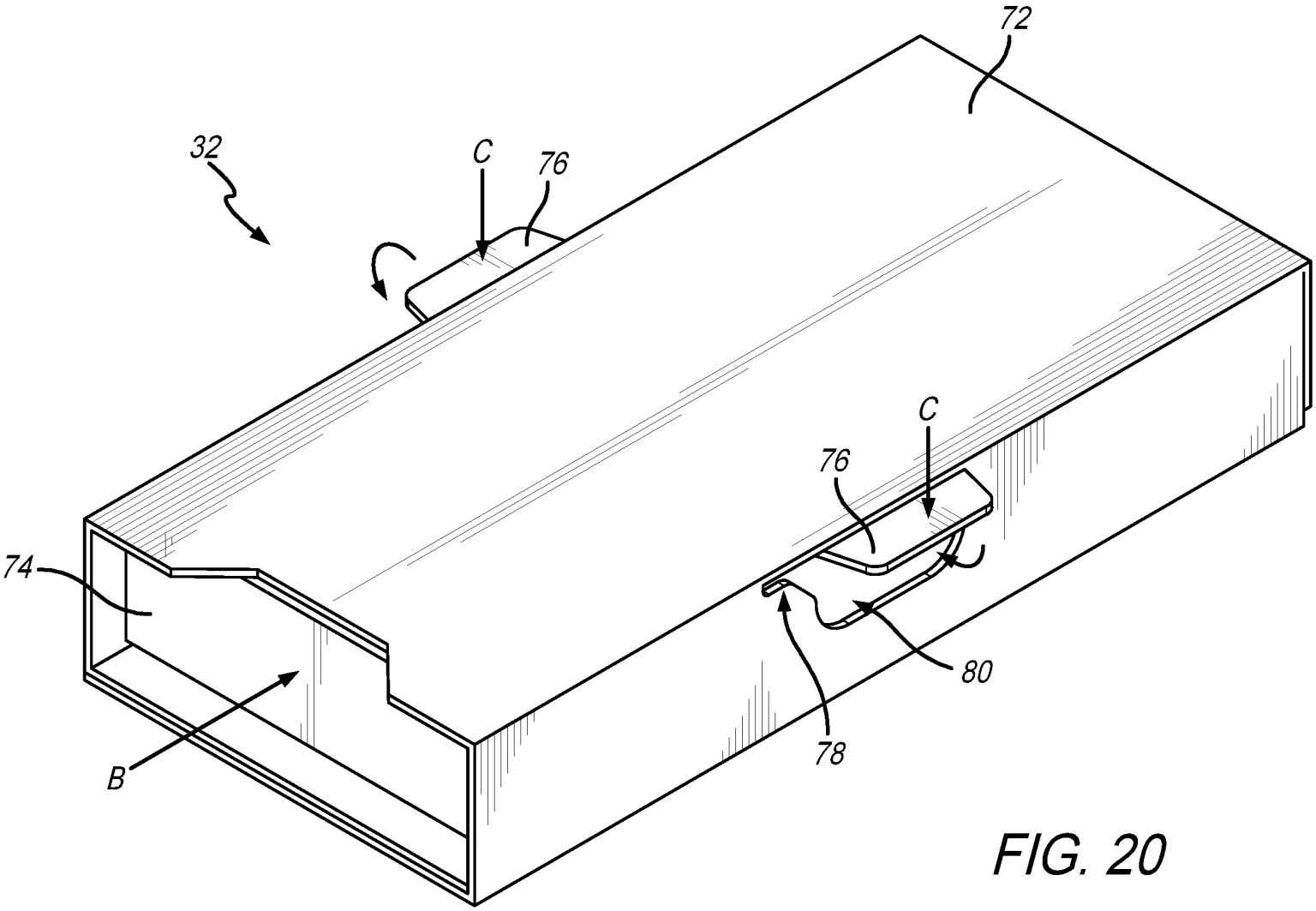
FIG. 20 is a perspective view of the child-resistant box similar to FIG. 13, further illustrating inward movement of an alternative inner storage container and inward rotation of the pair of safety tabs within a now aligned corresponding pair of release channels in the outer housing.
Figure 21:
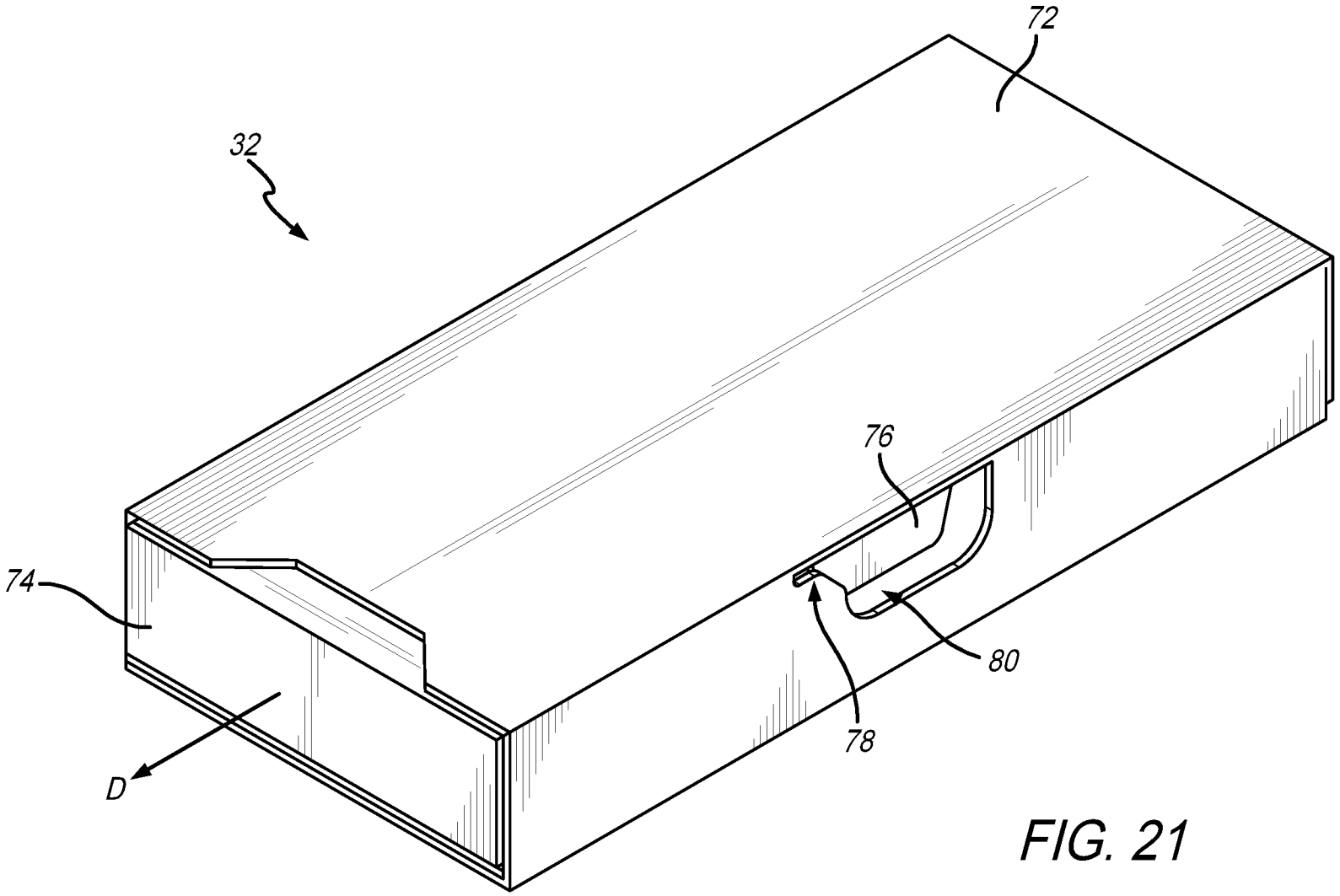
FIG. 21 is a perspective view similar to FIG. 20, further illustrating outward movement of the inner storage container with the pair of safety tabs positioned within the outer housing.
Figure 22:
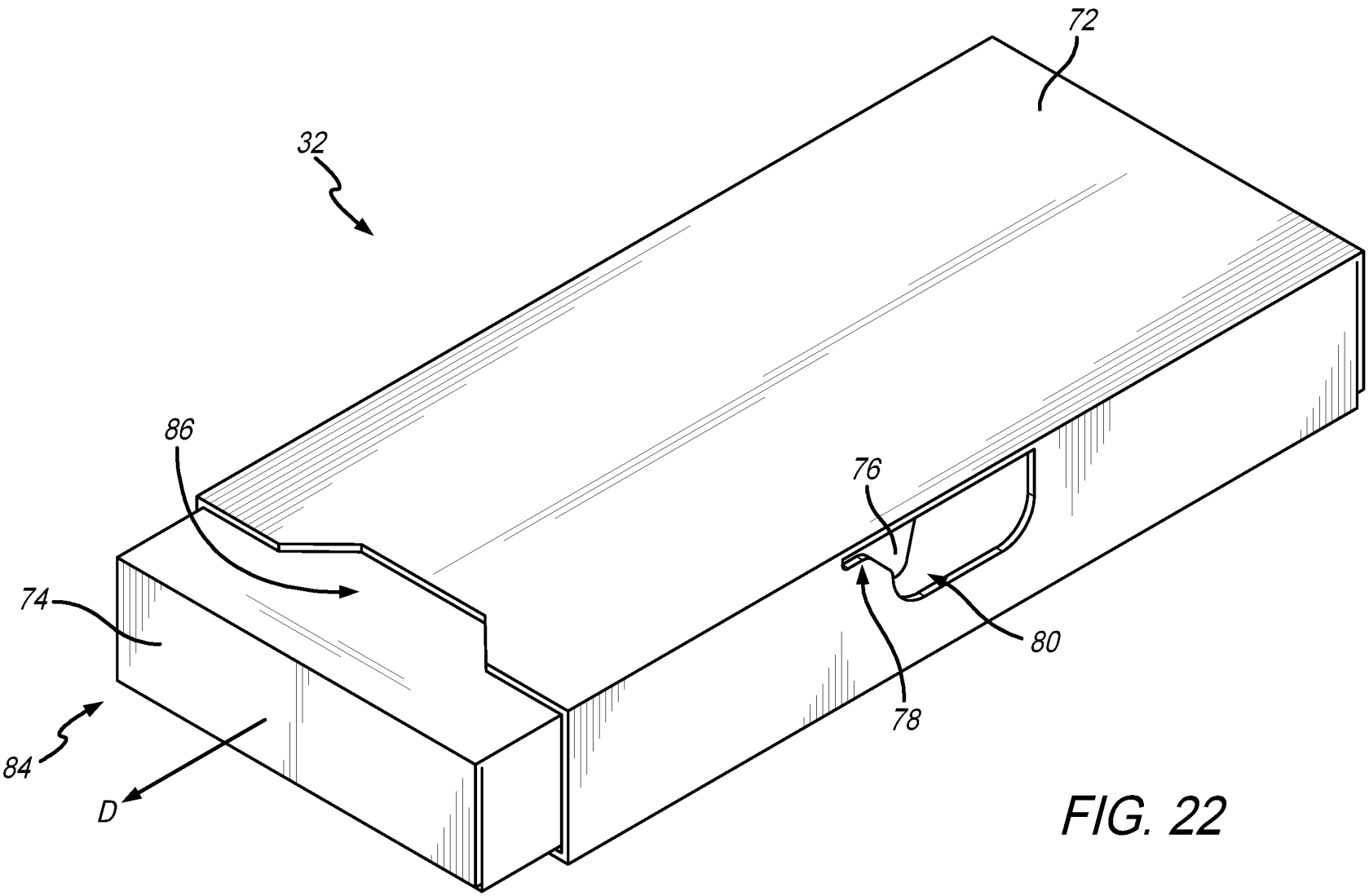
FIG. 22 is a perspective view similar to FIG. 21, further illustrating slide out removal of the inner storage container out from within the outer housing.
Figure 23:
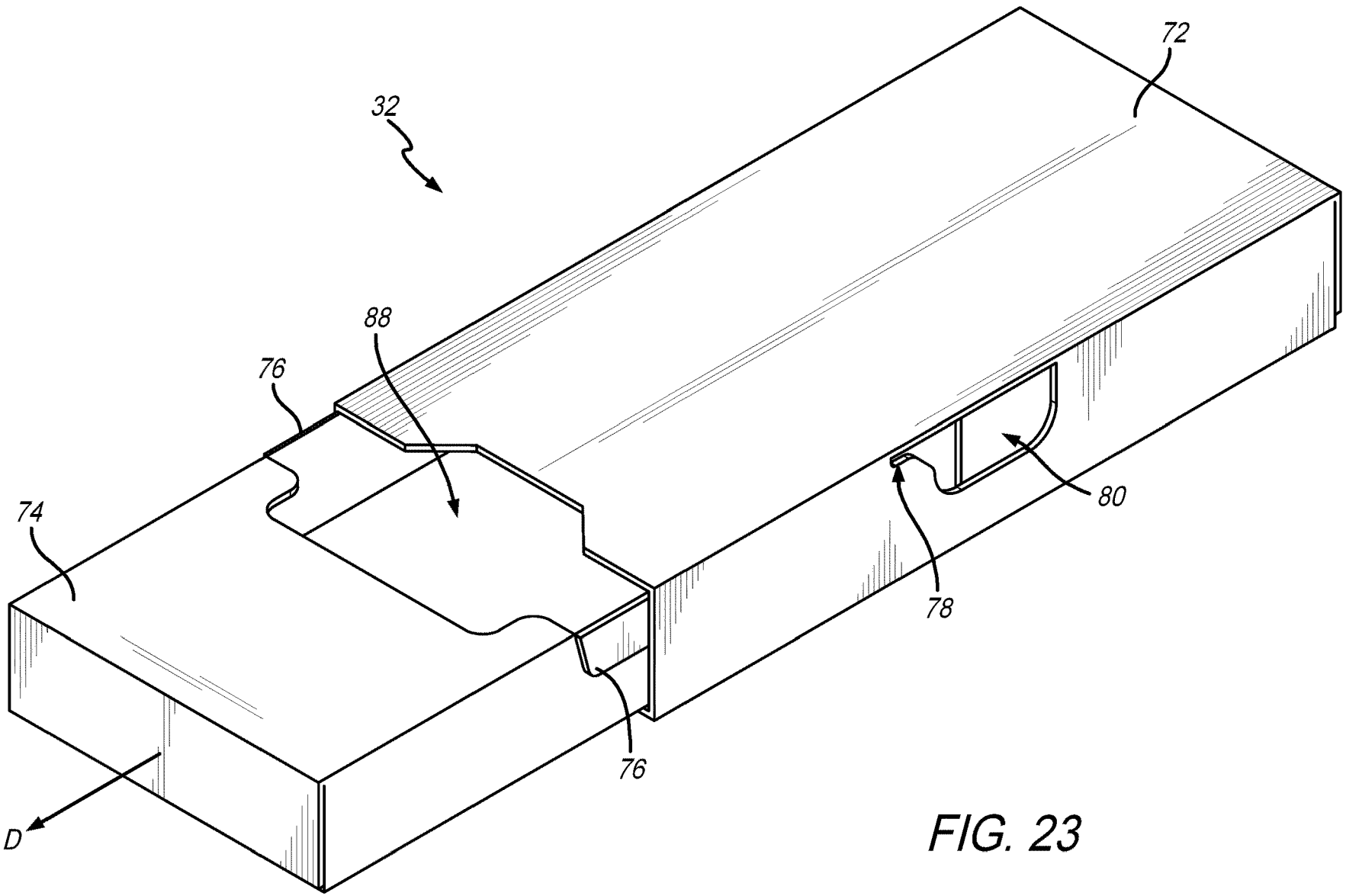
FIG. 23 is a perspective view similar to FIGS. 21 and 22, further illustrating removal of the inner storage container from the outer housing.
Figure 24:
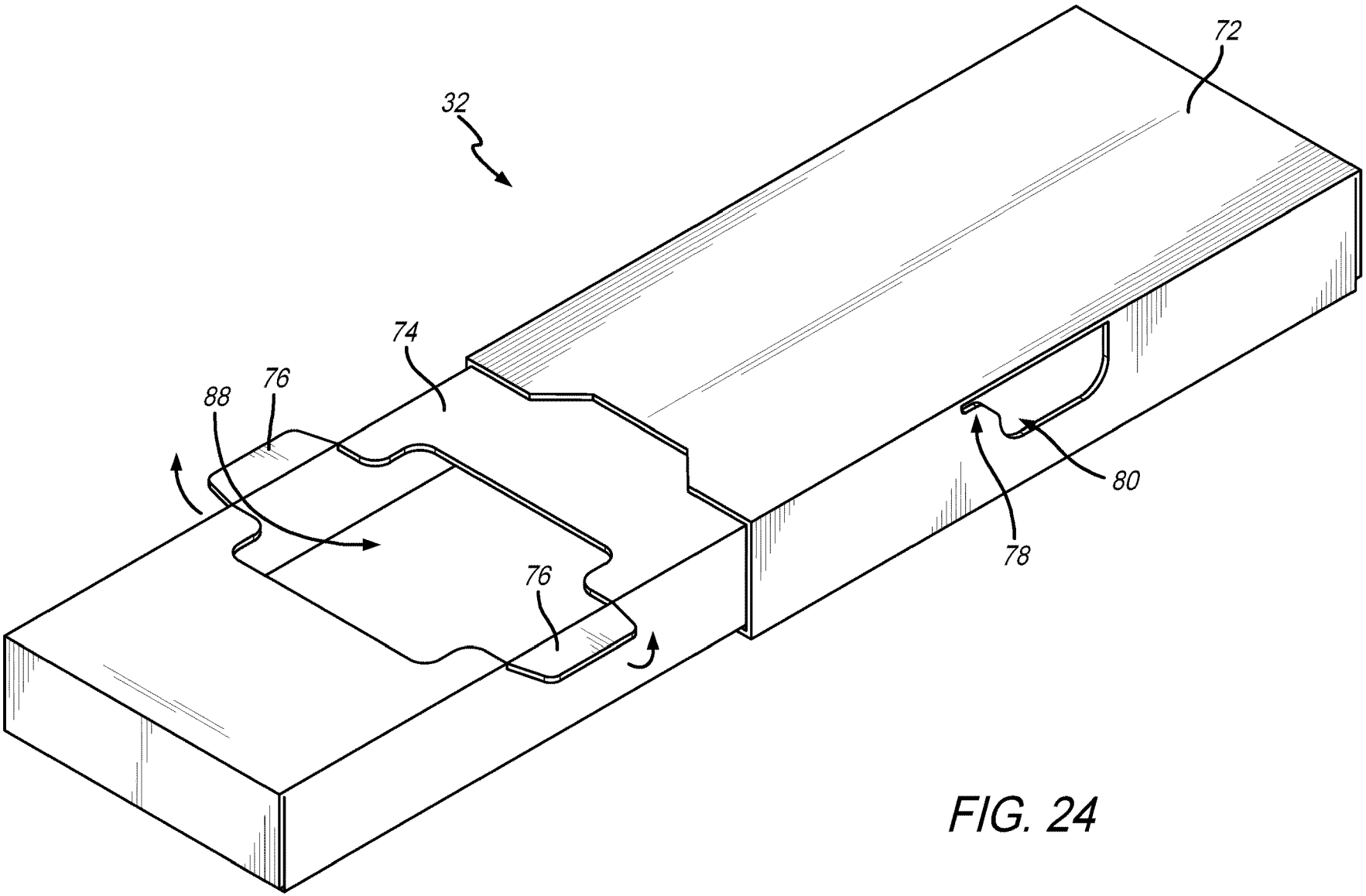
FIG. 24 is a perspective view similar to FIGS. 21-23, further illustrating outward rotation of each of the safety tabs to a normal vertical configuration with substantial removal of the inner storage container from the outer housing.

In operation, FIG. 20 illustrates applying a force along Arrow B to depress the storage container 74 within the outer housing 72 against the spring 82 located therein. Such movement of the storage container 74 within the outer housing 72 causes each of the safety tabs 76 to move out of engagement with each of the locking channels 78 and into general alignment with each of the release channels 80. Here, as also illustrated in FIG. 20, the safety tabs 76 may fold or bend inwardly toward the body of the inner storage container 74 and through the opening formed by the relatively larger release channels 80. At this point, releasing application of the force applied along Arrow B (FIG. 20) allows the internally located spring 82 to push the inner storage container 72 out from within the outer housing 72 along Arrow D (FIG. 21) to the eventual resting position illustrated in FIG. 22. Here, as shown in FIG. 22, the inwardly folded safety tabs 76 remain folded flush against the inner storage container 74 and within the outer housing 72, and are otherwise no longer extending out from either of the locking channels 78 or the release channels 80. As shown in FIG. 22, a portion of the front end 84 of the storage container 74 extends out from within the interior of the outer housing 72 to permit better hand manipulation thereof for purposes grasping and removing the inner storage container 74 out from within the outer housing 72. In this respect, the outer housing 72 may include a notch 86 that exposes a greater surface area of the inner storage container 74, as generally illustrated in FIG. 22, to help facilitate hand grasping removal therefrom.

The fact that each of the safety tabs 76 have been folded flush with the inner storage container 74 through the release channels 80 and to a position within the interior of the outer housing 72 prevents the safety tabs 76 from reengaging the locking channels 78 upon slide-out removal of the inner storage container 74. As such, as illustrated in progression from FIG. 22 to FIG. 24, the safety tabs 76 are now free to move or slide within the outer housing 72 so the storage container 74 may be pulled out from within the outer housing 72 for purposes of exposing an inner storage cavity 88 therein. The inner storage cavity 88 may be designed to store medicinal products, such as gummies, candies, or other edibles or consumables.

Figure 25:
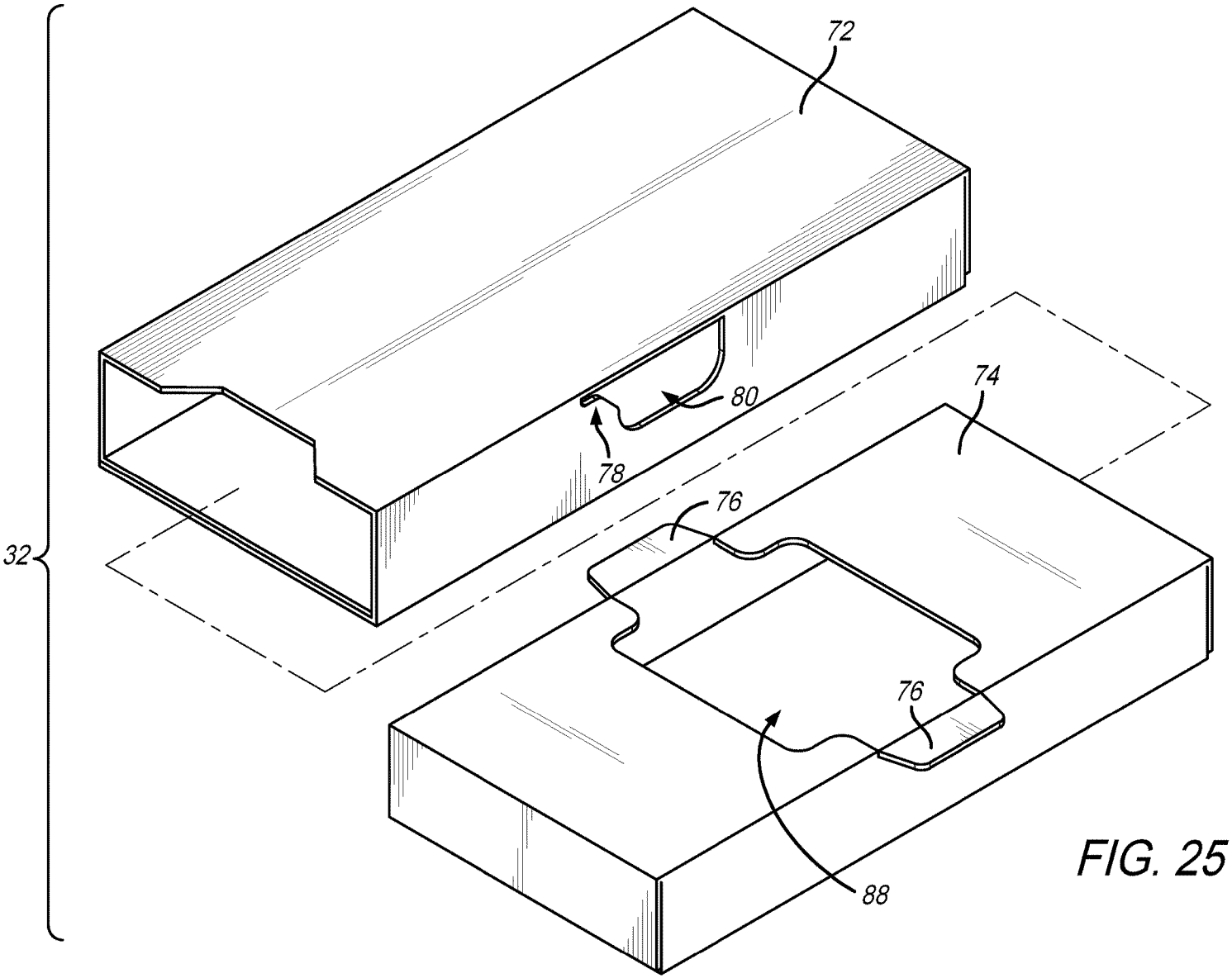
FIG. 25 is an exploded perspective view illustrating the inner storage container completely removed from the outer housing.
Figure 26:
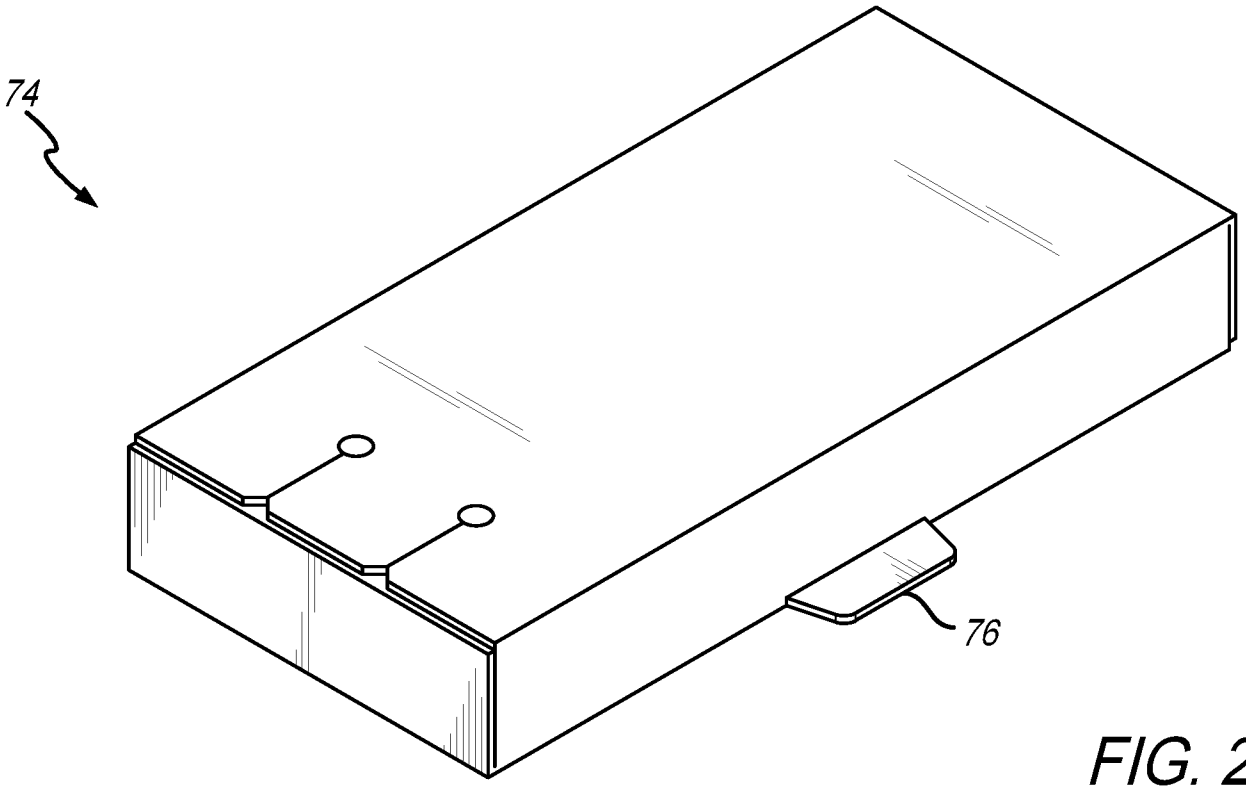
FIG. 26 is a bottom perspective view of the removed inner storage container.
Figure 27:
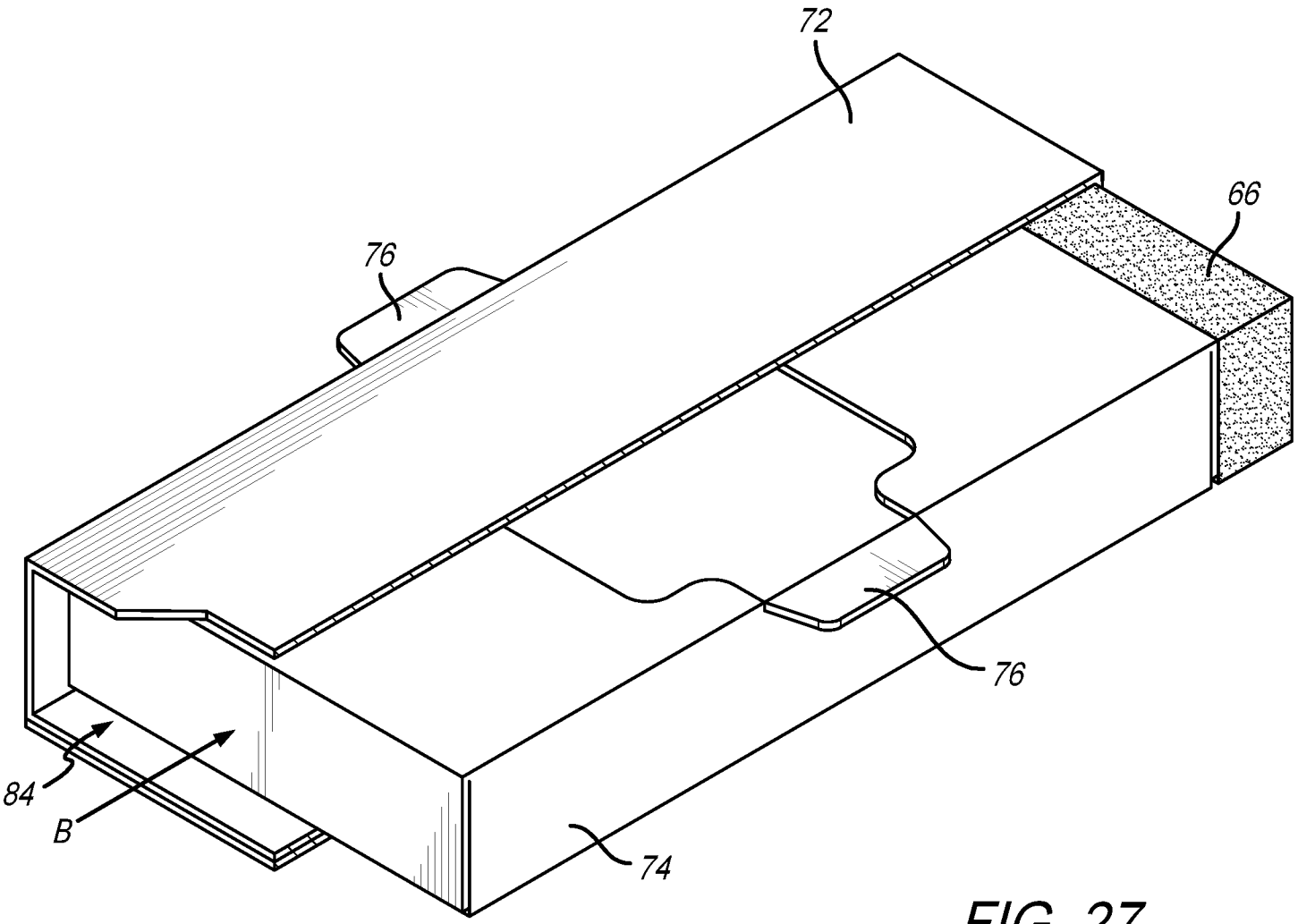
FIG. 27 is a partial cut-away perspective view illustrating an internally located sponge in a compressed position.
Figure 28:
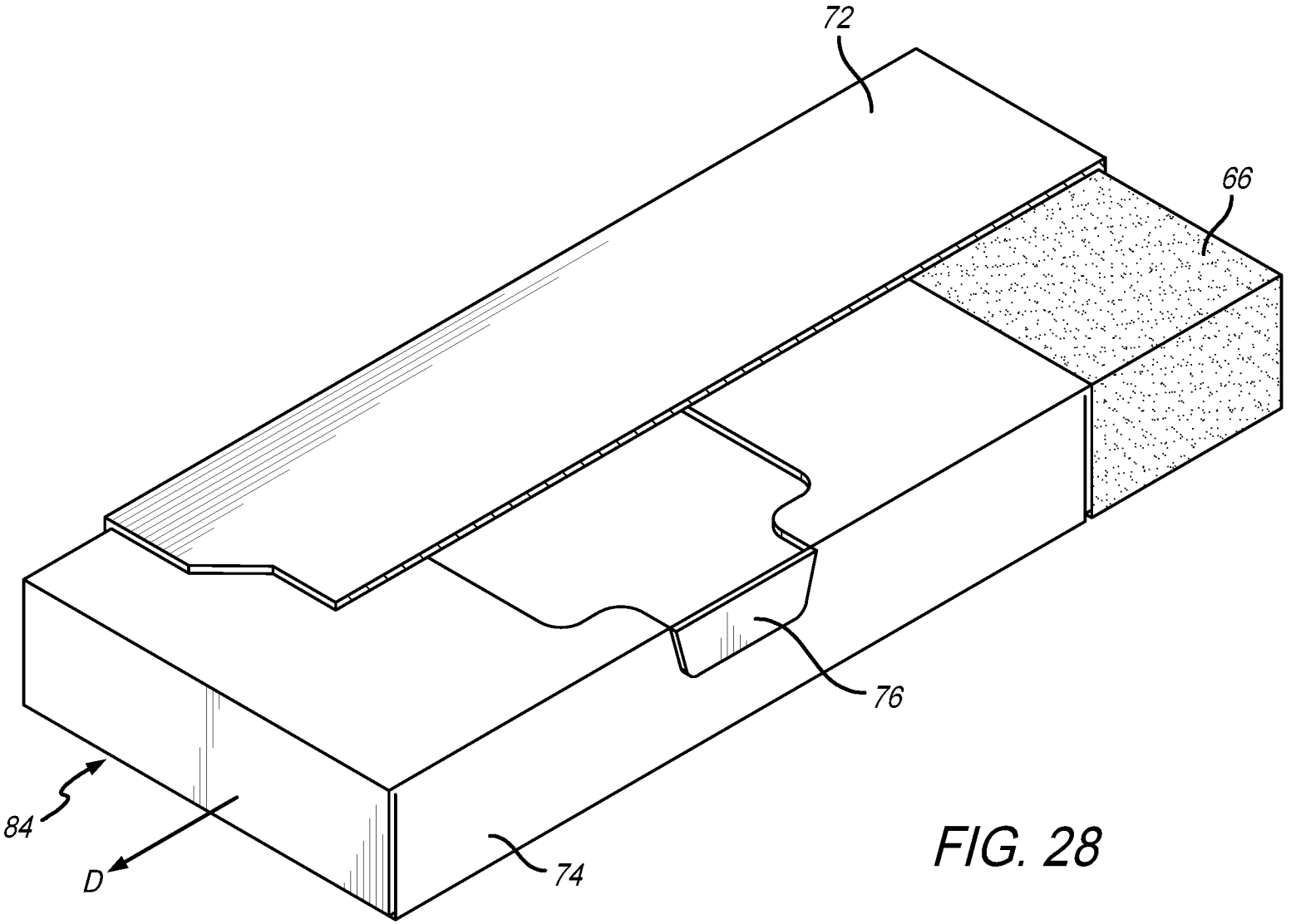
FIG. 28 is a partial cut-away perspective view illustrating the internally located sponge in a normal uncompressed position.

In this respect, FIG. 25 illustrates the inner storage container 74 completely removed out from within the interior of the outer housing 72 and in exploded relation relative thereto. Once removed, each of the safety tabs 76 may spring outwardly back into a normal generally perpendicular position as illustrated in FIGS. 25 and 26.

The storage container 74 may be reinserted within the interior of the outer housing 72 by folding each of the safety tabs 76 flush with an outer surface thereof to fit within the inner side walls of the outer housing 74. Here, sliding the storage container 74 back into the outer housing 72 allows the safety tabs 76 to travel flush therein until realigned with the release channel 80. Accordingly, when the safety tabs 76 realign with the respective release channels 80, each of the safety tabs 76 spring bias outwardly, thereby extending out from within the interior of the outer housing 74 and into the position illustrated, e.g., in FIG. 20. Releasing the storage container 74 from depressing the spring 82 causes the spring 82 to push the inner storage container 74 back to a normal engaged position wherein each of the safety tabs 76 reside within each of the now aligned respective locking channels 78. Consequently, though the front end 84 of the inner storage container 74 projects out from within the outer housing 72, engagement of the safety tabs 76 within each of the locking channels 78 prevents removal therefrom. In effect, the inner storage cavity 88 is locked and no longer easily accessible by, e.g., a child.

As briefly mentioned above, FIGS. 36-44 illustrate an alternative embodiment of the child-resistant tin 30" incorporating two of the locking systems 40, 40". As illustrated best in FIGS. 43 and 44, the locking systems 40, 40" are incorporated into adjacent sidewalls, namely the locking system 40 is incorporated into a front sidewall 90 while the locking system 40" is incorporated into a right sidewall 92. Here, the locking systems 40, 40" operate in substantially the same manner as disclosed above with respect to the child-resistant tins 30, 30', except that both of the locking systems 40, 40" must be operated concurrently or simultaneously to release the lid 36 from locking engagement with the storage container 34. As an example, FIG. 44 illustrates simultaneous depression of all of the release buttons 70 of the locking systems 40, 40" along the directional Arrows A and B indicated therein, such that the respective downwardly facing planar shoulders 54 of each of the slide blocks 68 slides back out from engagement with the inwardly curved lip 56 of the lid 34. This movement allows the lid 34 to pivot rearwardly to open access to the storage container 34. Once forward pressure along directional Arrows A and B is released, the springs 66 push the release buttons 70 forward to reposition the downwardly facing planar shoulders 54 out from within the respective sidewalls 90, 92 and in a position to catch the inwardly curved lip 56 of the lid 36, when the lid 36 pivots back about the hinge 38 to a closed position as illustrated in FIGS. 36-42.

In alternative embodiments, the locking systems 40, 40" do not necessarily need to be formed from adjacent sidewalls. For example, one of the locking systems 40, 40" may be formed in any one of the front side wall 90, the right sidewall 92, a left sidewall, or a rear sidewall thereof, while the other of the locking systems 40, 40" may be formed in any of the other of the front side wall 90, the right sidewall 92, the left sidewall, or the rear sidewall thereof (e.g., in embodiments wherein the geometric shape of the child-resistant tin is a square). Of course, in other embodiments, the child-resistant tin may include three or more of the locking systems 40, 40',40". For example, in one embodiment, locking engagement may be through use of all three of the locking systems 40, 40',40" located within three separate sidewalls of the storage container 34 (e.g., the front sidewall 90, the right sidewall 92, and left sidewall). Also, the locking systems 40, 40',40" may be mixed and matched. For example, in one embodiment, the storage container 34 may have two of the locking systems 40 integrated into the left and right sidewalls, while the locking system 40' may be integrated into the front sidewall. Of course, in embodiments wherein the child-resistant tin includes a different number of sidewalls (e.g., if the child-resistant tin where a hexagon), more than three of the locking systems 40, 40',40" may be incorporated therein to enhance the difficulty of opening the lid 36 relative to the storage container 34 to enhance security related thereto.

Although several embodiments have been described in detail for purposes of illustration, various modifications may be made without departing from the scope and spirit of the invention. Accordingly, the invention is not to be limited, except as by the appended claims.

What is claimed is:

1. A child-resistant tin, comprising:

a storage container having an inner cavity;

a lid movable relative to the storage container between a closed position enclosing the inner cavity and an open position providing access to the inner cavity;

a first lock movable between an extended position positioned for locking engagement with the lid and an unlocked position disengaged from the lid; and a second lock movable independent of the first lock between an extended position for locking engagement with the lid and an unlocked position disengaged from the lid, the first lock and the second lock independently retain the lid in the closed position such that the lid is only pivotable therefrom to the open position by way of cooperative movement of the first lock to its unlocked position and movement of the second lock to its unlocked position concurrently;

wherein the first lock and the second lock are disposed within the inner cavity and enclosed by a protective sheath having a size and shape to accommodate each of the first lock and the second lock thereunder.

2. The child-resistant tin of claim 1, wherein the protective sheath comprises a food-grade material.

3. The child-resistant tin of claim 1, wherein the storage container includes a generally vertical annular shoulder that transitions at an inwardly projecting step to an interiorly located upper rim having a wall thickness relatively smaller than the annular shoulder.

4. The child-resistant tin of claim 3, wherein the lid includes a downwardly extending annular skirt having a reciprocal shape for seated reception on the inwardly projecting step when the lid is in the closed position.

5. The child-resistant tin of claim 4, wherein the downwardly extending annular skirt encompasses the upper rim.

6. The child-resistant tin of claim 1, wherein the first lock and the second lock each include a respective slide block having an outwardly facing release button movable with a locking catch normally biased into an outwardly extended position for engagement with a lip of the lid.

7. The child-resistant tin of claim 6, wherein the locking catches each include a downwardly facing planar shoulder having a size and shape to remain in locking engagement with the lip.

8. The child-resistant tin of claim 7, wherein the locking catch includes a rounded upper surface opposite a downwardly facing planar shoulder.

9. The child-resistant tin of claim 6, wherein the first lock and the second lock each include a respective lock housing having an interior channel therein for housing a spring generally biasing the slide block in the outwardly extended position.

10. The child-resistant tin of claim 6, wherein the first lock includes two of the release buttons and the second lock includes one of the release buttons.

11. The child-resistant tin of claim 1, wherein the first lock is formed integral with a first sidewall of the storage container and the second lock is formed integral with a second sidewall of the storage container adjacent the first sidewall.

12. The child-resistant tin of claim 11, including a third lock movable between an extended position positioned for locking engagement with the lid and an unlocked position disengaged from the lid, the first lock, the second lock, and the third lock independently retain the lid in the closed position such that the lid is only pivotable from the closed position to the open position by way of cooperative movement of the first lock to its unlocked position, the second lock to its unlocked position, and the third lock to its unlocked position concurrently.

13. The child-resistant tin of claim 1, wherein the tin comprises a rectangular shape.

14. A child-resistant package, comprising:

a storage container;

a lid coupled with the storage container about a hinge and pivotable between a closed position and an open position; and a first lock and a second lock positioned within the storage container and independently operative of one another, the first lock and the second lock each including at least one release button biased into a forward position wherein a catch operable therewith is positioned to retain the lid in the closed position, each release button being depressible into the storage container independent of one another to move out from within engagement of the lid, the lid being movable from the closed position to the open position only when the release button of the first lock and the release button of the second lock are concurrently depressed into the storage container;

wherein the first lock and the second lock each include a lock housing retaining a spring therein in engagement with a slide block having the respective release button extending therefrom.

15. The child-resistant package of claim 14, wherein each respective release button extends out from a sidewall of the storage container for easy fingertip depression.

16. The child-resistant package of claim 15, wherein the first lock is formed from a front sidewall of the storage container and the second lock is formed from an adjacent sidewall of the storage container.

17. The child-resistant package of claim 14, wherein each catch includes a downwardly facing planar shoulder having a surface area for retaining an inwardly curved lip of the lid when the lid is in the closed position.

18. The child-resistant package of claim 14, wherein the catch includes an arcuate upper surface permitting slide-over movement of the lid from the open position to the closed position.

19. The child-resistant package of claim 14, wherein the child-resistant package comprises a metal material selected from the group consisting of steel, aluminum, or a metal alloy.

20. The child-resistant package of claim 14, including a food-grade sheath disposed in an inner surface of the storage container and including a size and shape to accommodate the first lock and the second lock thereunder.

21. The child-resistant package of claim 14, wherein the storage container includes at least one sidewall having an annular shoulder transitioning at an inwardly projecting step to an interiorly located upper rim having a wall thickness relatively smaller than the annular shoulder, the inwardly projecting step receiving a downwardly extending annular skirt of the lid in seated reception when the child-resistant package is in the closed position.

22. The child-resistant package of claim 21, wherein the downwardly extending annular skirt encompasses the upper rim when in seated reception on the inwardly projecting step.

23. The child-resistant package of claim 14, including a third lock independently operable of the first lock and the second lock, wherein each of the first lock, the second lock, and the third lock are formed from a different sidewall of the storage container.

24. A child-resistant tin, comprising:

a storage container having an inner cavity and a generally vertical annular shoulder that transitions at an inwardly projecting step to an interiorly located upper rim having a wall thickness relatively smaller than the annular shoulder;

a lid movable relative to the storage container between a closed position enclosing the inner cavity and an open position providing access to the inner cavity;

a first lock movable between an extended position positioned for locking engagement with the lid and an unlocked position disengaged from the lid; and a second lock movable independent of the first lock between an extended position for locking engagement with the lid and an unlocked position disengaged from the lid, the first lock and the second lock independently retain the lid in the closed position such that the lid is only pivotable therefrom to the open position by way of cooperative movement of the first lock to its unlocked position and movement of the second lock to its unlocked position concurrently.

25. A child-resistant tin, comprising:

a storage container having an inner cavity;

a lid movable relative to the storage container between a closed position enclosing the inner cavity and an open position providing access to the inner cavity;

a first lock movable between an extended position positioned for locking engagement with the lid and an unlocked position disengaged from the lid; and a second lock movable independent of the first lock between an extended position for locking engagement with the lid and an unlocked position disengaged from the lid, the first lock and the second lock independently retain the lid in the closed position such that the lid is only pivotable therefrom to the open position by way of cooperative movement of the first lock to its unlocked position and movement of the second lock to its unlocked position concurrently;

wherein the first lock and the second lock each include a respective slide block having an outwardly facing release button movable with a locking catch normally biased into an outwardly extended position for engagement with a lip of the lid.

26. A child-resistant tin, comprising:

a storage container having an inner cavity;

a lid movable relative to the storage container between a closed position enclosing the inner cavity and an open position providing access to the inner cavity;

a first lock formed integral with a first sidewall of the storage container and movable between an extended position positioned for locking engagement with the lid and an unlocked position disengaged from the lid; and a second lock formed integral with a second sidewall of the storage container adjacent the first sidewall and movable independent of the first lock between an extended position for locking engagement with the lid and an unlocked position disengaged from the lid, the first lock and the second lock independently retain the lid in the closed position such that the lid is only pivotable therefrom to the open position by way of cooperative movement of the first lock to its unlocked position and movement of the second lock to its unlocked position concurrently.

27. A child-resistant package, comprising:

a storage container;

a lid coupled with the storage container about a hinge and pivotable between a closed position and an open position; and a first lock formed from a front sidewall of the storage container and a second lock formed from an adjacent sidewall of the storage container and positioned within the storage container and independently operative of one another, the first lock and the second lock each including at least one release button biased into a forward position wherein a catch operable therewith is positioned to retain the lid in the closed position, each release button being depressible into the storage container independent of one another to move out from within engagement of the lid, the lid being movable from the closed position to the open position only when the release button of the first lock and the release button of the second lock are concurrently depressed into the storage container;

wherein each respective release button extends out from a sidewall of the storage container for easy fingertip depression.

28. A child-resistant package, comprising:

a storage container;

a lid coupled with the storage container about a hinge and pivotable between a closed position and an open position; and a first lock and a second lock positioned within the storage container and independently operative of one another, the first lock and the second lock each including at least one release button biased into a forward position wherein a catch operable therewith is positioned to retain the lid in the closed position, each release button being depressible into the storage container independent of one another to move out from within engagement of the lid, the lid being movable from the closed position to the open position only when the release button of the first lock and the release button of the second lock are concurrently depressed into the storage container, and wherein the catch includes a downwardly facing planar shoulder having a surface area for retaining an inwardly curved lip of the lid when the lid is in the closed position.

29. A child-resistant package, comprising:

a storage container;

a lid coupled with the storage container about a hinge and pivotable between a closed position and an open position; and a first lock and a second lock positioned within the storage container and independently operative of one another, the first lock and the second lock each including at least one release button biased into a forward position wherein a catch operable therewith is positioned to retain the lid in the closed position, each release button being depressible into the storage container independent of one another to move out from within engagement of the lid, the lid being movable from the closed position to the open position only when the release button of the first lock and the release button of the second lock are concurrently depressed into the storage container, and wherein the catch includes an arcuate upper surface permitting slide-over movement of the lid from the open position to the closed position.

30. A child-resistant package, comprising:

a storage container;

a lid coupled with the storage container about a hinge and pivotable between a closed position and an open position;

a first lock and a second lock positioned within the storage container and independently operative of one another, the first lock and the second lock each including at least one release button biased into a forward position wherein a catch operable therewith is positioned to retain the lid in the closed position, each release button being depressible into the storage container independent of one another to move out from within engagement of the lid, the lid being movable from the closed position to the open position only when the release button of the first lock and the release button of the second lock are concurrently depressed into the storage container; and a food-grade sheath disposed in an inner surface of the storage container and including a size and shape to accommodate the first lock and the second lock thereunder.

31. A child-resistant package, comprising:

a storage container having at least one sidewall having an annular shoulder transitioning at an inwardly projecting step to an interiorly located upper rim having a wall thickness relatively smaller than the annular shoulder;

a lid coupled with the storage container about a hinge and pivotable between a closed position and an open position, the inwardly projecting step receiving a downwardly extending annular skirt of the lid in seated reception when the child-resistant package is in the closed position; and a first lock and a second lock positioned within the storage container and independently operative of one another, the first lock and the second lock each including at least one release button biased into a forward position wherein a catch operable therewith is positioned to retain the lid in the closed position, each release button being depressible into the storage container independent of one another to move out from within engagement of the lid, the lid being movable from the closed position to the open position only when the release button of the first lock and the release button of the second lock are concurrently depressed into the storage container.

32. A child-resistant package, comprising:

a storage container;

a lid coupled with the storage container about a hinge and pivotable between a closed position and an open position;

a first lock and a second lock positioned within the storage container and independently operative of one another, the first lock and the second lock each including at least one release button biased into a forward position wherein a catch operable therewith is positioned to retain the lid in the closed position, each release button being depressible into the storage container independent of one another to move out from within engagement of the lid, the lid being movable from the closed position to the open position only when the release button of the first lock and the release button of the second lock are concurrently depressed into the storage container; and a third lock independently operable of the first lock and the second lock, wherein each of the first lock, the second lock, and the third lock are formed from a different sidewall of the storage container.

* * * * *